US011574583B2

(12) United States Patent
Ko et al.

(10) Patent No.: US 11,574,583 B2
(45) Date of Patent: Feb. 7, 2023

(54) LIGHT EMITTING DISPLAY PANEL AND LIGHT EMITTING DISPLAY APPARATUS INCLUDING THE SAME

(71) Applicant: LG Display Co., Ltd., Seoul (KR)

(72) Inventors: Intae Ko, Paju-si (KR); Kyeongseob Kwon, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/465,711

(22) Filed: Sep. 2, 2021

(65) Prior Publication Data

US 2022/0148494 A1 May 12, 2022

(30) Foreign Application Priority Data

Nov. 9, 2020 (KR) ..... 10-2020-0148837

(51) Int. Cl.

| | |
|---|---|
| ***G09G 3/32*** | (2016.01) |
| ***G09G 3/3225*** | (2016.01) |
| ***G09G 3/3233*** | (2016.01) |
| *G09G 3/00* | (2006.01) |

(52) U.S. Cl.

CPC ..... *G09G 3/32* (2013.01); *G09G 3/3225* (2013.01); *G09G 3/3233* (2013.01); *G09G 3/006* (2013.01); *G09G 2300/0809* (2013.01); *G09G 2310/0243* (2013.01); *G09G 2310/0267* (2013.01); *G09G 2310/0275* (2013.01); *G09G 2320/029* (2013.01); *G09G 2320/043* (2013.01); *G09G 2320/045* (2013.01); *G09G 2330/028* (2013.01); *G09G 2330/12* (2013.01)

(58) Field of Classification Search

CPC ..... G09G 3/30; G09G 3/32; G09G 3/3225; G09G 3/3241; G09G 3/325; G09G 2300/0439; G09G 2300/0809; G09G 2310/0243; G09G 2310/0267; G09G 2310/0275; G09G 3/006; G09G 3/3233; G09G 2320/029; G09G 2320/043; G09G 2320/045; G09G 2330/028; G09G 2330/12

USPC ..... 345/214, 76, 82, 204, 207

See application file for complete search history.

(56) References Cited

U.S. PATENT DOCUMENTS

| | | | | |
|---|---|---|---|---|
| 10,510,293 | B2 * | 12/2019 | Jung | G09G 3/3258 |
| 2009/0108763 | A1 * | 4/2009 | Han | G09G 3/3233 315/169.3 |
| 2011/0122119 | A1 | 5/2011 | Bae et al. | |
| 2013/0300724 | A1 | 11/2013 | Chaji | |
| 2015/0187276 | A1 | 7/2015 | Shim et al. | |
| 2016/0240132 | A1 * | 8/2016 | Takahiro | G09G 3/3233 |

(Continued)

*Primary Examiner* — Jason M Mandeville

(74) *Attorney, Agent, or Firm* — Seed IP Law Group LLP

(57) ABSTRACT

The light emitting display panel includes a plurality of pixels, a plurality of gate lines transferring gate signals to the plurality of pixels, a plurality of data lines transferring data voltages to the plurality of pixels, and a sensing line connected to a plurality of light emitting devices respectively included in the plurality of pixels. Each of the plurality of pixels includes a light emitting device, a sensing control transistor including a first terminal connected to a first terminal of the light emitting device and a gate connected to a sensing control line, and a sensing switching transistor including a first terminal connected to a second terminal of the sensing control transistor, a second terminal connected to the sensing line, and a gate connected to a sensing switching line.

18 Claims, 12 Drawing Sheets

(56) References Cited

U.S. PATENT DOCUMENTS

| | | | | |
|---|---|---|---|---|
| 2017/0154577 | A1* | 6/2017 | Lee | G09G 3/3233 |
| 2018/0151656 | A1* | 5/2018 | Choo | G09G 3/3291 |

* cited by examiner

LIGHT EMITTING DISPLAY PANEL AND LIGHT EMITTING DISPLAY APPARATUS INCLUDING THE SAME

CROSS-REFERENCE TO RELATED APPLICATIONS

This application claims the benefit of the Korean Patent Application No. 10-2020-0148837 filed on Nov. 9, 2020, which is hereby incorporated by reference as if fully set forth herein.

BACKGROUND

Technical Field

The present disclosure relates to a light emitting display panel and a light emitting display apparatus including the same.

Description of the Related Art

Light emitting display apparatuses are display apparatuses which emit light by using a light emitting device and include a light emitting display panel including a plurality of light emitting devices.

As the light emitting display apparatuses are continuously used, the light emitting devices are degraded, and thus, characteristics of the light emitting devices are changed. Due to this, the light emitting devices do not normally emit light.

Sensing of the light emitting devices is performed for checking the degree of characteristic change of the light emitting devices.

BRIEF SUMMARY

The inventors have appreciated that in the light emitting display apparatuses, a plurality of pixels are connected to a sensing line, and when one pixel connected to the sensing line is sensed, currents leaked from other pixels connected to the sensing line are transferred through the sensing line. Therefore, a problem may occur where one light emitting device connected to the sensing line is not accurately sensed. The inventors of the present disclosure have provided one or more embodiments addressing this identified problem as well as other technical problems in the related art.

Accordingly, the present disclosure is directed to providing a light emitting display panel and a light emitting display apparatus including the same that substantially obviate one or more problems due to limitations and disadvantages of the related art.

An aspect of the present disclosure is directed to providing a light emitting display panel and a light emitting display apparatus including the same, which prevent a leakage current from occurring in pixels where sensing is not performed on a light emitting device.

Additional advantages and features of the disclosure will be set forth in part in the description which follows and in part will become apparent to those having ordinary skill in the art upon examination of the following or may be learned from practice of the disclosure. The technical benefits and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided a light emitting display panel including a plurality of pixels, a plurality of gate lines transferring gate signals to the plurality of pixels, a plurality of data lines transferring data voltages to the plurality of pixels, and a sensing line connected to a plurality of light emitting devices respectively included in the plurality of pixels, wherein each of the plurality of pixels includes a light emitting device, a sensing control transistor including a first terminal connected to a first terminal of the light emitting device and a gate connected to a sensing control line, and a sensing switching transistor including a first terminal connected to a second terminal of the sensing control transistor, a second terminal connected to the sensing line, and a gate connected to a sensing switching line.

In another aspect of the present disclosure, there is provided a light emitting display apparatus including a light emitting display panel including a plurality of pixels, a gate driver supplying a gate signal to a gate line included in the light emitting display panel, a data driver supplying a data voltage to a data line included in the light emitting display panel and converting a sensing signal, transferred through a sensing line included in the light emitting display panel, into sensing data, a controller storing the sensing data, and a switching driver connecting the data line or the sensing line to the data driver on the basis of a switching driver control signal transferred from the controller, wherein the sensing line is connected to a plurality of light emitting devices respectively included in the plurality of pixels, and each of the plurality of pixels includes a light emitting device, a sensing control transistor including a first terminal connected to a first terminal of the light emitting device and a gate connected to a sensing control line, and a sensing switching transistor including a first terminal connected to a second terminal of the sensing control transistor, a second terminal connected to the sensing line, and a gate connected to a sensing switching line.

It is to be understood that both the foregoing general description and the following detailed description of the present disclosure are explanatory and are intended to provide further examples of the disclosure as claimed.

BRIEF DESCRIPTION OF THE SEVERAL VIEWS OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
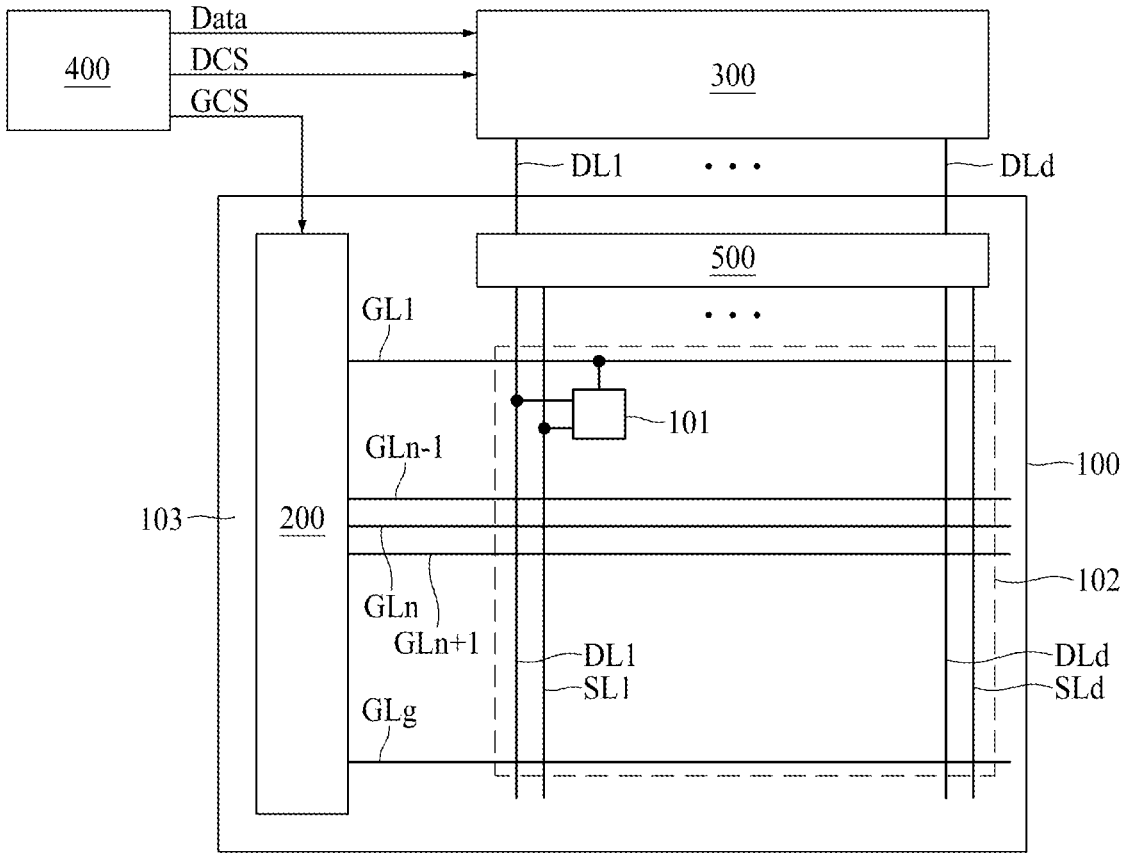
FIG. 1 is a diagram illustrating a configuration of a light emitting display apparatus according to an embodiment of the present disclosure.

Reference will now be made in detail to the embodiments of the present disclosure, examples of which are illustrated in the accompanying drawings. Wherever possible, the same reference numbers will be used throughout the drawings to refer to the same or like parts.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted. In a case where 'comprise,' 'have,' and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when a position relation between two parts is described as 'on~,' 'over~,' 'under~,' and 'next~', one or more other parts may be disposed between the two parts unless 'just' or 'direct' is used.

In describing a time relationship, for example, when the temporal order is described as 'after~,' 'subsequent~,' 'next~,' and 'before~,' a case which is not continuous may be included unless 'just' or 'direct' is used.

It will be understood that, although the terms "first," "second," etc., may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing the elements of the present disclosure, terms such as first, second, A, B, (a), (b), etc., may be used. Such terms are used for merely discriminating the corresponding elements from other elements and the corresponding elements are not limited in their essence, sequence, or precedence by the terms. It will be understood that when an element or layer is referred to as being "on" or "connected to" another element or layer, it can be directly on or directly connected to the other element or layer, or intervening elements or layers may be present. Also, it should be understood that when one element is disposed on or under another element, this may denote a case where the elements are disposed to directly contact each other, but may denote that the elements are disposed without directly contacting each other.

The term "at least one" should be understood as including any and all combinations of one or more of the associated listed elements. For example, the meaning of "at least one of a first element, a second element, and a third element" denotes the combination of all elements proposed from two or more of the first element, the second element, and the third element as well as the first element, the second element, or the third element.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of the present disclosure will be described in detail with reference to the accompanying drawings.

Figure 2:
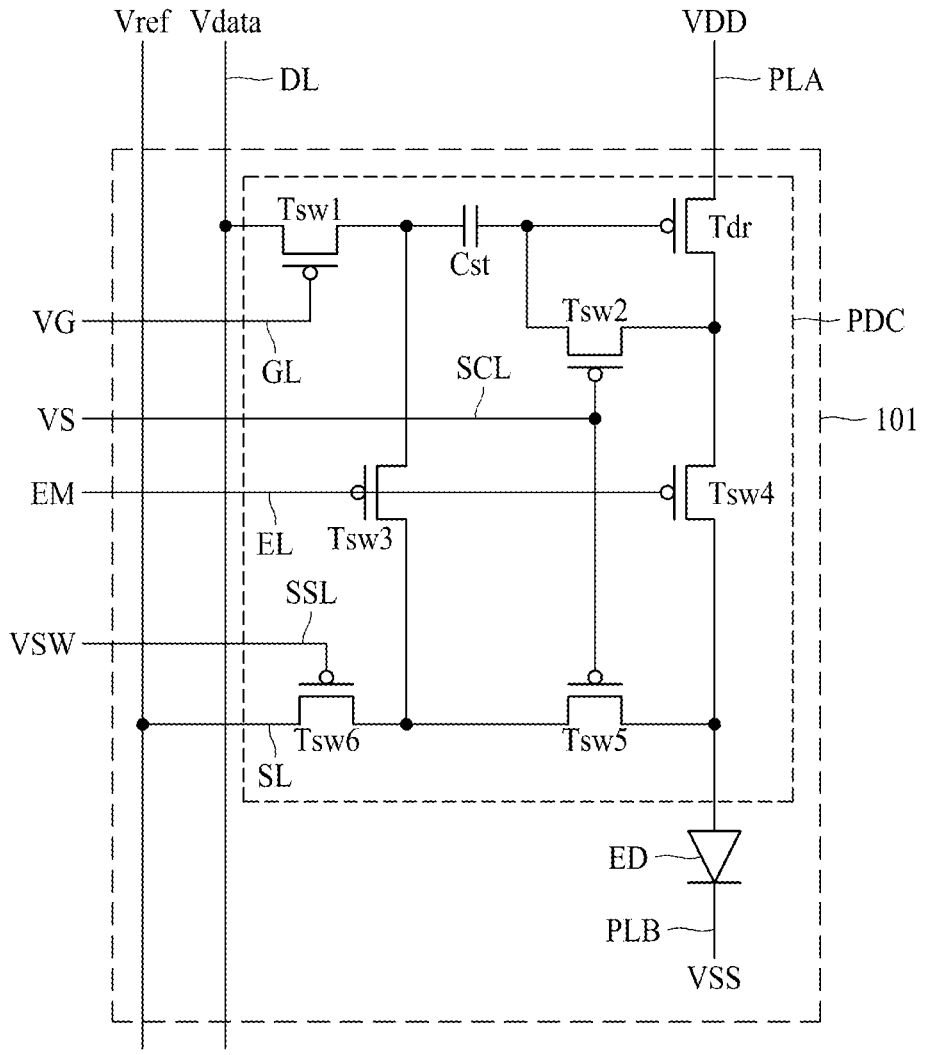
FIG. 2 is a diagram illustrating a structure of a pixel applied to a light emitting display apparatus according to an embodiment of the present disclosure.
Figure 3:
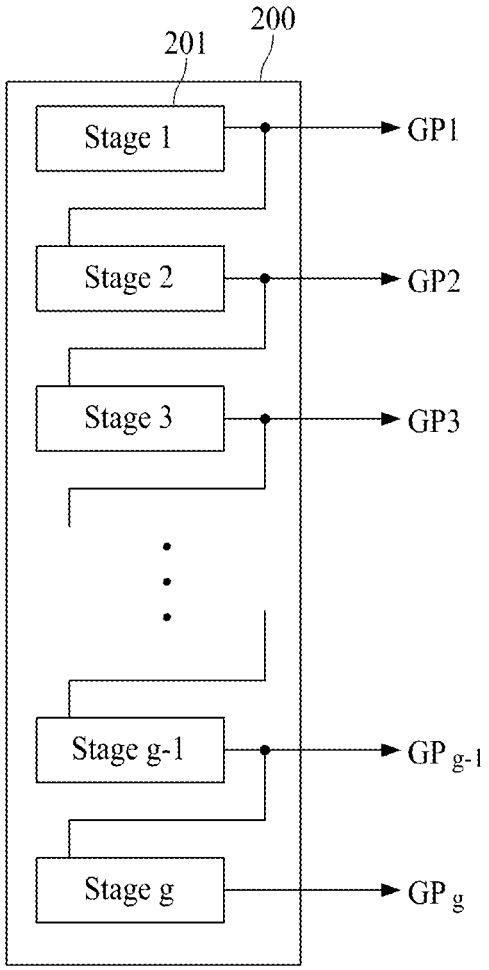
FIG. 3 is a diagram illustrating a configuration of a gate driver applied to a light emitting display apparatus according to an embodiment of the present disclosure.
Figure 4:
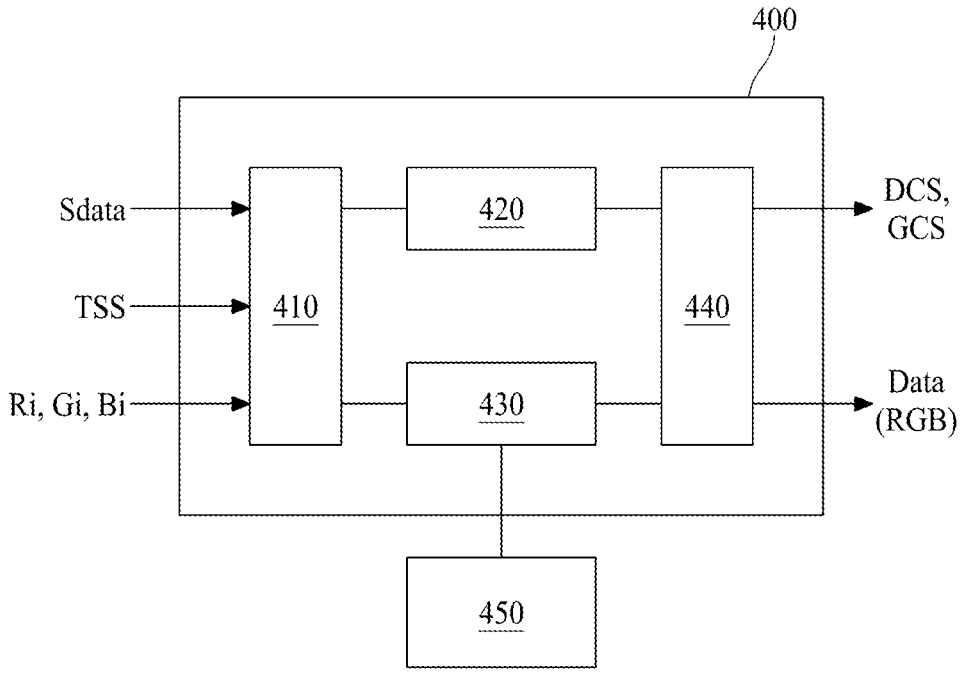
FIG. 4 is a diagram illustrating a configuration of a controller applied to a light emitting display apparatus according to an embodiment of the present disclosure.

FIG. 1 is a diagram illustrating a configuration of a light emitting display apparatus according to an embodiment of the present disclosure. FIG. 2 is a diagram illustrating a structure of a pixel applied to a light emitting display apparatus according to an embodiment of the present disclosure. FIG. 3 is a diagram illustrating a configuration of a gate driver applied to a light emitting display apparatus according to an embodiment of the present disclosure. FIG. 4 is a diagram illustrating a configuration of a controller applied to a light emitting display apparatus according to an embodiment of the present disclosure.

The light emitting display apparatus according to an embodiment of the present disclosure may configure various kinds of electronic devices. The electronic devices may include, for example, smartphones, tablet personal computers (PCs), televisions (TVs), and monitors.

The light emitting display apparatus according to an embodiment of the present disclosure, as illustrated in FIG. 1, may include a light emitting display panel 100 including a plurality of pixels 101, a gate driver 200 which supplies a gate signal to a gate line GL included in the light emitting display panel 100, a data driver 300 which supplies a data voltage to a data line DL included in the light emitting display panel 100 and converts a sensing signal, transferred through a sensing line SL included in the light emitting display panel 100, into sensing data, a controller 400 which stores the sensing data, and a switching driver 500 which connects the data line DL or the sensing line SL to the data driver 300 on the basis of a switching driver control signal transferred from the controller 400.

First, the light emitting display panel 100 may include a display area 102 and a non-display area 103. A plurality of gate lines GL1 to GLg, a plurality of data lines DL1 to DLd, a plurality of sensing lines SL1 to SLd, and a plurality of pixels 101 may be provided in the display area 102.

For example, as illustrated in FIG. 2, the pixel 101 included in the light emitting display panel 100 may include a light emitting device ED, first to fourth transistors Tsw1 to Tsw4, a capacitor Cst, a driving transistor Tdr, a sensing control transistor Tsw5, and a sensing switching transistor Tsw6. That is, the pixel 101 may include a pixel driving circuit PDC and a light emitting unit, and the pixel driving circuit PDC may include the first to fourth transistors Tsw1 to Tsw4, the capacitor Cst, the driving transistor Tdr, the sensing control transistor Tsw5, and the sensing switching transistor Tsw6. The light emitting unit may include the light emitting device ED.

The light emitting device ED may include one of an organic light emitting layer, an inorganic light emitting layer, and a quantum dot light emitting layer, or may include a stack or combination structure of an organic light emitting layer (or an inorganic light emitting layer) and a quantum dot light emitting layer.

Moreover, the light emitting device ED may emit light corresponding to one of various colors such as red, green, and blue, or may emit white light.

The first transistor Tsw1 configuring the pixel driving circuit PDC may be turned on or off based on a gate signal VG supplied through the gate line GL, and when the first transistor Tsw1 is turned on, a data voltage Vdata supplied through the data line DL may be supplied to the driving transistor Tdr. A first voltage VDD may be supplied to the driving transistor Tdr and the light emitting device ED through a first voltage supply line PLA, and a second voltage VSS may be supplied to the light emitting device ED through the second voltage supply line PLB. The second transistor Tsw2 and the sensing control transistor Tsw5 may be turned on or off based on a sensing control signal VS supplied through the sensing control line SCL. The third transistor Tsw3 and the fourth transistor Tsw4 may be turned on or off based on an emission signal EM supplied through an emission line EL. The sensing switching transistor Tsw6 may be turned on or off based on a sensing switching signal VSW supplied through a sensing switching line SSL, and the sensing switching transistor Tsw6 may be connected between the sensing line SL and the sensing control transistor Tsw5. A reference voltage Vref may be supplied to the sensing switching transistor Tsw6 through the sensing line SL, and a sensing signal associated with a characteristic change of the light emitting device ED may be transferred to the sensing line SL through the sensing switching transistor Tsw6.

The pixel 101 applied to the present disclosure may be configurated in a structure illustrated in FIG. 2, but the present disclosure is not limited thereto. Hereinafter, a light emitting display apparatus including a plurality of pixels 101 having a structure illustrated in FIG. 2 will be described as an example of the present disclosure. A structure of the pixel 101 illustrated in FIG. 2 will be described below in more detail.

Each of the pixels 101 may include the light emitting device ED and the pixel driving circuit PDC.

The pixel driving circuit PDC may include the sensing control transistor Tsw5 which includes a first terminal connected to a first terminal of the light emitting device ED and a gate connected to the sensing control line SCL, the sensing switching transistor Tsw6 which includes a first terminal connected to a second terminal of the sensing control transistor Tsw5, a second terminal connected to the sensing line SL, and a gate connected to the sensing switching line SSL, the first transistor Tsw1 which includes a first terminal connected to the data line DL and a gate connected to the gate line GL, the driving transistor Tdr which includes a first terminal connected to the first voltage supply line PLA, the capacitor Cst which is connected between a second terminal of the first transistor Tsw1 and a gate of the driving transistor Tdr, the second transistor Tsw2 which includes a first terminal connected to the gate of the driving transistor Tdr, a second terminal connected to a second terminal of the driving transistor Tdr, and a gate connected to the sensing control line SCL, the third transistor Tsw3 which includes a first terminal connected to the second terminal of the first transistor Tsw1, a second terminal connected to the second terminal of the sensing control transistor Tsw5 and the first terminal of the sensing switching transistor Tsw6, and a gate connected to the emission line EL, and the fourth transistor Tsw4 which includes a first terminal connected to the second terminal of the driving transistor Tdr, a second terminal connected to the first terminal of the light emitting device ED, and a gate connected to the emission line EL.

In this case, in the light emitting display panel 100, a plurality of pixel areas including the pixels 101 may be arranged, and a plurality of signal lines for supplying various signals to the pixel driving circuit PDC included in the pixel 101 may be provided.

For example, in the light emitting display panel including the pixel 101 as illustrated in FIG. 2, the signal lines may include the gate line GL, the data line DL, the emission line EL, the sensing control line SCL, the first voltage supply line PLA, the sensing switching line SSL, a second voltage supply line PLB, and the sensing line SL.

In this case, the gate line GL and the data line DL may be provided in different directions, and the sensing line SL may be provided in a first direction parallel to the data line DL and may be connected to the sensing switching transistors Tsw6 of pixels provided in the first direction.

For example, as illustrated in FIG. 1, in a case where the data line DL and the sensing line SL are provided in the first direction (e.g., a lengthwise direction) of the light emitting display panel 100, the gate line GL may be in the second direction (e.g., a widthwise direction) of the light emitting display panel 100. The first direction may be vertical to the second direction, but is not limited thereto and the first direction and the second direction may form various angles therebetween.

To provide an additional description, the light emitting display panel 100 may include the plurality of pixels 101, the plurality of gate lines GL1 to GLg which transfer a plurality of gate signals VG to the pixels 101, the plurality of data lines DL1 to DLd which transfer data voltages to the pixels 101, and the plurality of sensing lines SL1 to SLd which are connected to a plurality of light emitting devices ED respectively included in the pixels 101. In this case, each of the pixels 101 may include the light emitting device ED, the sensing control transistor Tsw5 which includes the first terminal connected to the first terminal of the light emitting device ED and the gate connected to the sensing control line SCL, and the sensing switching transistor Tsw6 which includes the first terminal connected to the second terminal of the sensing control transistor Tsw5, the second terminal connected to the sensing line SL, and the gate connected to the sensing switching line SSL.

The data driver 300 may be provided in a form of a chip-on film (COF) attached on the light emitting display panel 100 and may be connected to a main substrate including the controller 400. In this case, the COF may include a plurality of lines which electrically connect the controller 400, the data driver 300, and the light emitting display panel 100, and accordingly, in some embodiments, the lines may electrically connect the main substrate to a plurality of pads included in the light emitting display panel 100. The main substrate may be electrically connected to an external substrate with an external system mounted thereon.

The data driver 300 may be directly mounted on the light emitting display panel 100, and then, may be electrically connected to the main substrate.

However, the data driver 300 may be implemented as one integrated circuit (IC) along with the controller 400, and the IC may be provided on the COF or may be directly mounted on the light emitting display panel 100.

The data driver 300 may receive a sensing signal, associated with a characteristic change of the light emitting device ED included in the light emitting display panel 100, from the light emitting display panel 100 and may transfer the sensing signal to the controller 400.

The gate driver 200 may be configured as an IC and may be mounted in the non-display area 103, or may be directly embedded into the non-display area 103 by using a gate in panel (GIP) type. In a case which uses the GIP type, a plurality of transistors configuring the gate driver 200 may be provided in the non-display area 103 through the same process as transistors included in each of the pixels 101 of the display area 102.

When a gate pulse generated by the gate driver 200 is supplied to the gate of the first transistor Tsw1 included in the pixel 101, the first transistor Tsw1 may be turned on. When a gate-off signal is supplied to the first transistor Tsw1, the first transistor Tsw1 may be turned off. The gate signal VG supplied through the gate line GL may include the gate pulse and the gate-off signal.

The gate driver 200, as illustrated in FIG. 3, may include a plurality of stages 201 which supply a plurality of gate pulses GP1 to GPg to the gate lines GL1 to GLg connected to the pixels 101.

Each of the stages 201 may include a plurality of transistors, and various kinds of clocks and voltages may be supplied to each of the stages 201.

Each of the stages 201 may generate the gate signal VG supplied to the gate lines GL1 to GLg, and moreover, as illustrated in FIG. 2, may further generate various signals (for example, a sensing control signal VS, an emission signal EM, and a sensing switching signal VSW).

In this case, the gate signal VG, the sensing control signal VS, the emission signal EM, and the sensing switching signal VSW supplied to one pixel 101 may be generated by one stage 201, or may be generated by at least two stages 201.

The above-described signals may be generated in various forms by using a configuration and a function of a currently known gate driver. Accordingly, a description of a detailed structure of the stage 201 for generating the above-described signals is omitted.

The controller 400 may include a data aligner 430 which realigns pieces of video data Ri, Gi, and Bi transmitted from the external system by using a timing synchronization signal TSS transmitted from the external system to supply pieces of realigned image data Data to the data driver 300, a control signal generator 420 which generates a gate control signal GCS and a data control signal DCS by using the timing synchronization signal TSS, an input unit 410 which receives the timing synchronization signal TSS and the pieces of video data Ri, Gi, and Bi transmitted from the external system and transfers the timing synchronization signal TSS and the pieces of video data Ri, Gi, and Bi to the data aligner 430 and the control signal generator 420, and an output unit 440 which outputs, to the data driver 300 or the gate driver 200, the pieces of image data Data generated by the data aligner 430 and the control signals GCS and DCS generated by the control signal generator 420.

The controller 400 may perform a function of storing sensing data Sdata transferred from the data driver 300, and accordingly, in some embodiments, the controller 400 may include a storage unit 450. However, the storage unit 450 may be provided as an independent element in the light emitting display apparatus.

The control signal generator 420 may generate a control signal (hereinafter simply referred to as a switching driver control signal) for controlling the switching driver 500.

The external system may perform a function of driving the controller 400 and an electronic device. That is, when the electronic device is a smartphone, the external system may receive various sound information, image information, and letter information over a wireless communication network and may transfer the received image information to the controller 400. The image information may include the pieces of input video data Ri, Gi, and Bi.

The switching driver 500 may connect the data line DL or the sensing line SL to the data driver 300 on the basis of a switching driver control signal transferred from the controller 400.

The switching driver 500 may be included in the data driver 300, or may be provided independently from the data driver 300.

When the switching driver 500 is an independent element, as illustrated in FIG. 1, the switching driver 500 may be provided in the non-display area 103, and particularly, may be provided in a region where the data driver 300 is provided. In the following description, a light emitting display apparatus including the switching driver 500 which is independently provided will be described as an example of the present disclosure.

A detailed configuration and function of the switching driver 500 will be described below with reference to FIG. 5.

Figure 5:
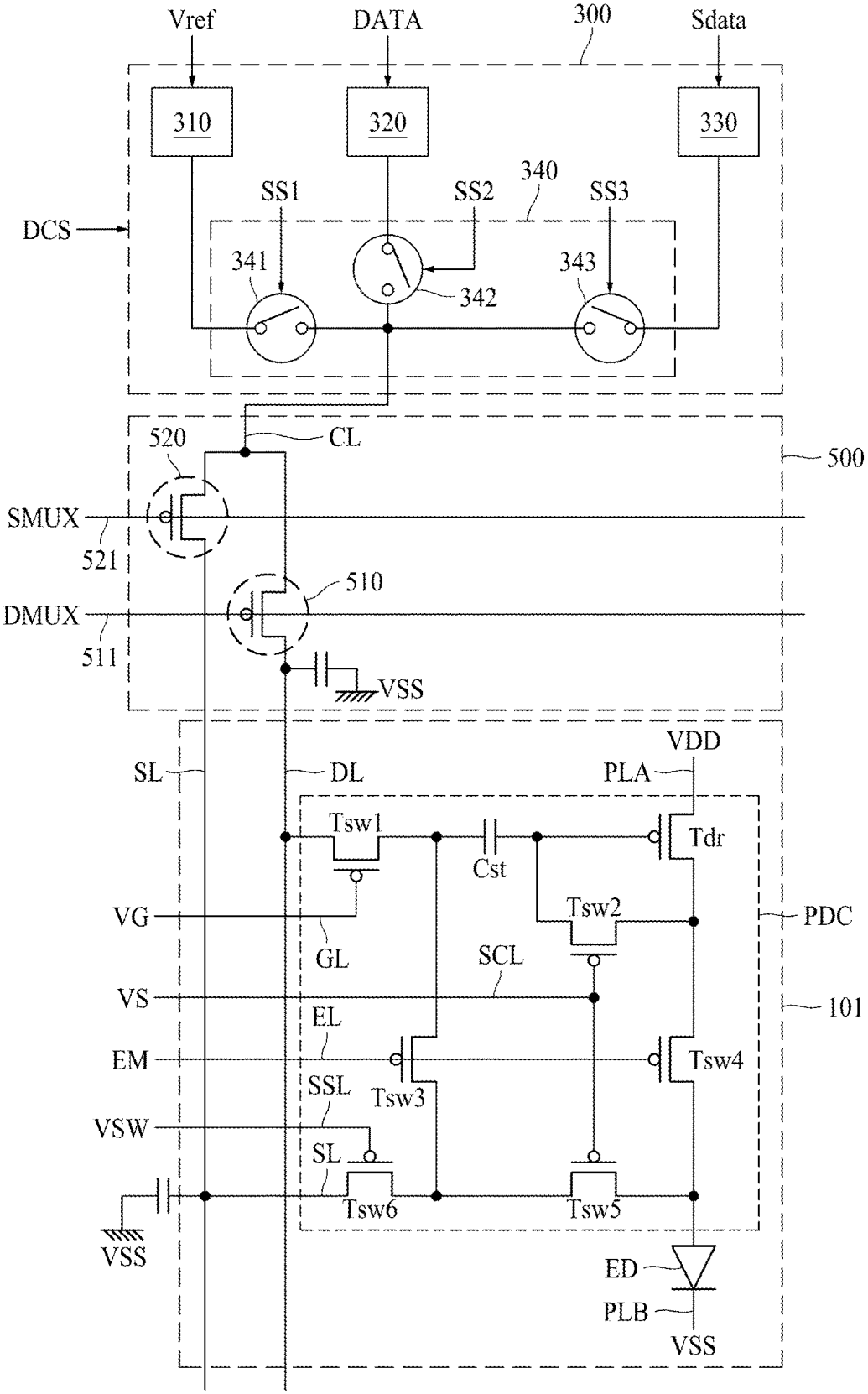
FIG. 5 is a diagram illustrating a structure of each of a data driver and a switching driver applied to a light emitting display apparatus according to an embodiment of the present disclosure.

FIG. 5 is a diagram illustrating a structure of each of a data driver and a switching driver applied to a light emitting display apparatus according to an embodiment of the present disclosure.

As described above, a data driver 300 may supply a data voltage to a data line DL included in the light emitting display panel 100 and may convert a sensing signal, transferred through a sensing line SL included in the light emitting display panel 100, into sensing data Sdata, and the sensing data Sdata may be transferred to the controller 400. Also, a switching driver 500 may connect the data line DL or the sensing line SL to the data driver 300 on the basis of the switching driver control signal transferred from the controller 400.

In order to perform the above-described function, the data driver 300 and the switching driver 500 may be configured as illustrated in FIG. 5.

First, the data driver 300 may include a data voltage generator 320 which generates data voltage Vdata which is to be transferred to the data line DL, a reference voltage transferor 310 which transfers a reference voltage Vref to the sensing line SL, a converter 330 which converts the sensing signal, transferred through the sensing line SL, into the sensing data Sdata and outputs the sensing data Sdata to the controller 400, and a switching unit 340 which connects the switching driver 500 to one of the data voltage generator 320, the reference voltage transferor 310, and the converter 330.

The reference voltage transferor 310 may directly generate and output the reference voltage Vref by using power supplied from a power supply, or may output the reference voltage Vref supplied from the power supply.

The data voltage generator 320 may convert digital image data DATA, transferred from the controller 400, into an analog data voltage Vdata and may output the analog data voltage Vdata. The data voltage generator 320 may be a data driver which is generally used for converting the image data DATA into the data voltage Vdata, and thus, a detailed description of the data voltage generator 320 is omitted.

The converter 330 may convert the sensing signal, transferred through the sensing line SL, into the sensing data Sdata and may output the sensing data Sdata to the controller 400. Accordingly, in some embodiments, the converter 330 may include an analog-to-digital converter (ADC) which converts an analog sensing signal into digital sensing data Sdata.

In order to accurately control an operation timing of each of the converter 330, the data voltage generator 320, and the reference voltage transferor 310, a switch may be included in each of the converter 330, the data voltage generator 320, and the reference voltage transferor 310, and a plurality of switches included in the converter 330, the data voltage generator 320, and the reference voltage transferor 310 may be controlled by the data control signal DCS transferred from the controller 400.

The data control signal DCS may include various control signals for controlling an operation timing of each of the reference voltage transferor 310, the data voltage generator 320, and the converter 330.

The switching unit 340 may connect the switching driver 500 to one of the reference voltage transferor 310, the data voltage generator 320, and the converter 330.

Accordingly, in some embodiments, the switching unit 340 may be connected to the switching driver 500 through one line (hereinafter simply referred to as a connection line CL) and may connect the connection line CL to one of the reference voltage transferor 310, the data voltage generator 320, and the converter 330 on the basis of a first switching control signal SS1, a second switching control signal SS2, and a third switching control signal SS3 transferred from the controller 400.

The first to third switching control signals SS1 to SS3 may be included in the data control signal DCS generated by the controller 400.

The switching unit 340 may include a first switch 341, a second switch 342, and a third switch 343.

The first switching control signal SS1 may control the first switch 341 connected between the reference voltage transferor 310 and the connection line CL, the second switching control signal SS2 may control the second switch 342 connected between the data voltage generator 320 and the connection line CL, and the third switching control signal SS3 may control the third switch 343 connected between the converter 330 and the connection line CL.

The first to third switches 341 to 343 may each include a transistor which is turned on or off by the first to third switching control signals SS1 to SS3.

Second, the switching driver 500 may include a first switching unit 510 which connects the data line DL to the data driver 300 and a second switching unit 520 which connects the sensing line SL to the data driver 300.

That is, the first switching unit 510 may be connected between the data line DL and the connection line CL, and the second switching unit 520 may be connected between the sensing line SL and the connection line CL.

When the data line DL is connected to the connection line CL by the first switching unit 510, the sensing line SL is not connected to the connection line CL by the second switching unit 520.

The first switching unit 510, as illustrated in FIG. 5, may include a transistor which includes a first terminal is connected to the connection line CL, a second terminal is connected to the data line DL, and a gate connected to the first signal line 511. A first control signal DMUX may be supplied to the first signal line 511.

The second switching unit 520, as illustrated in FIG. 5, may include a transistor which includes a first terminal is connected to the connection line CL, a second terminal is connected to the sensing line SL, and a gate connected to the second signal line 521. A second control signal SMUX may be supplied to the second signal line 511.

The switching driver control signal may include the first control signal DMUX and the second control signal SMUX.

The switching driver control signal, as described above, may be generated by the control signal generator 420 of the controller 400.

In order to prevent the occurrence of static electricity, one side of the capacitor may be connected to the data line DL, so as to prevent the occurrence of static electricity, and the other side of the capacitor may be connected to a line to which the second voltage VSS is supplied. Also, in order to prevent the occurrence of static electricity, the one side of the capacitor may be connected to the sensing line SL, and the other side of the capacitor may be connected to a line to which the second voltage VSS is supplied.

Figure 6:
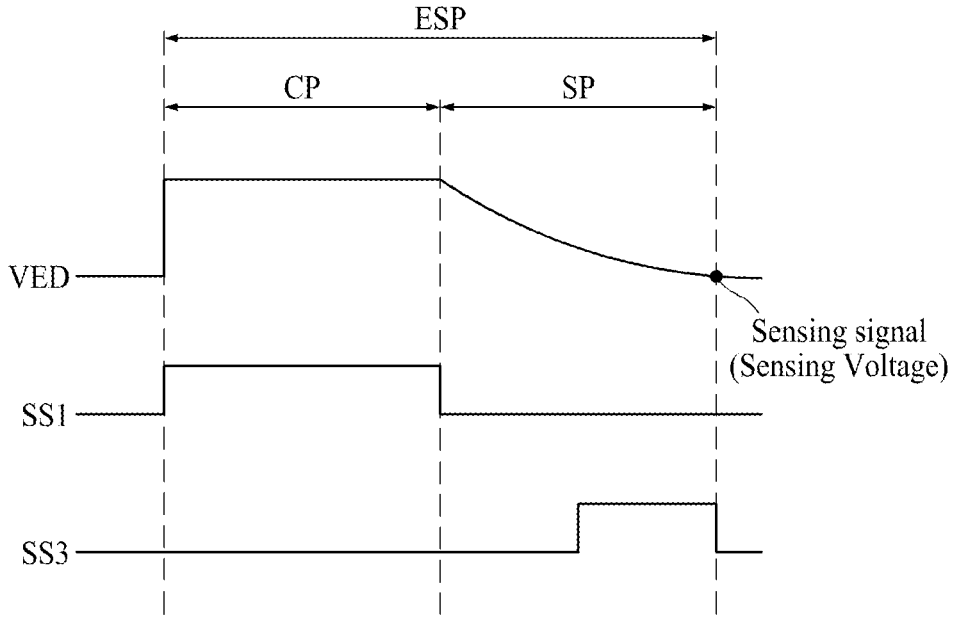
FIG. 6 is a diagram showing waveforms of applied signals in a light emitting device sensing period of a light emitting display apparatus according to an embodiment of the present disclosure.
Figure 7:
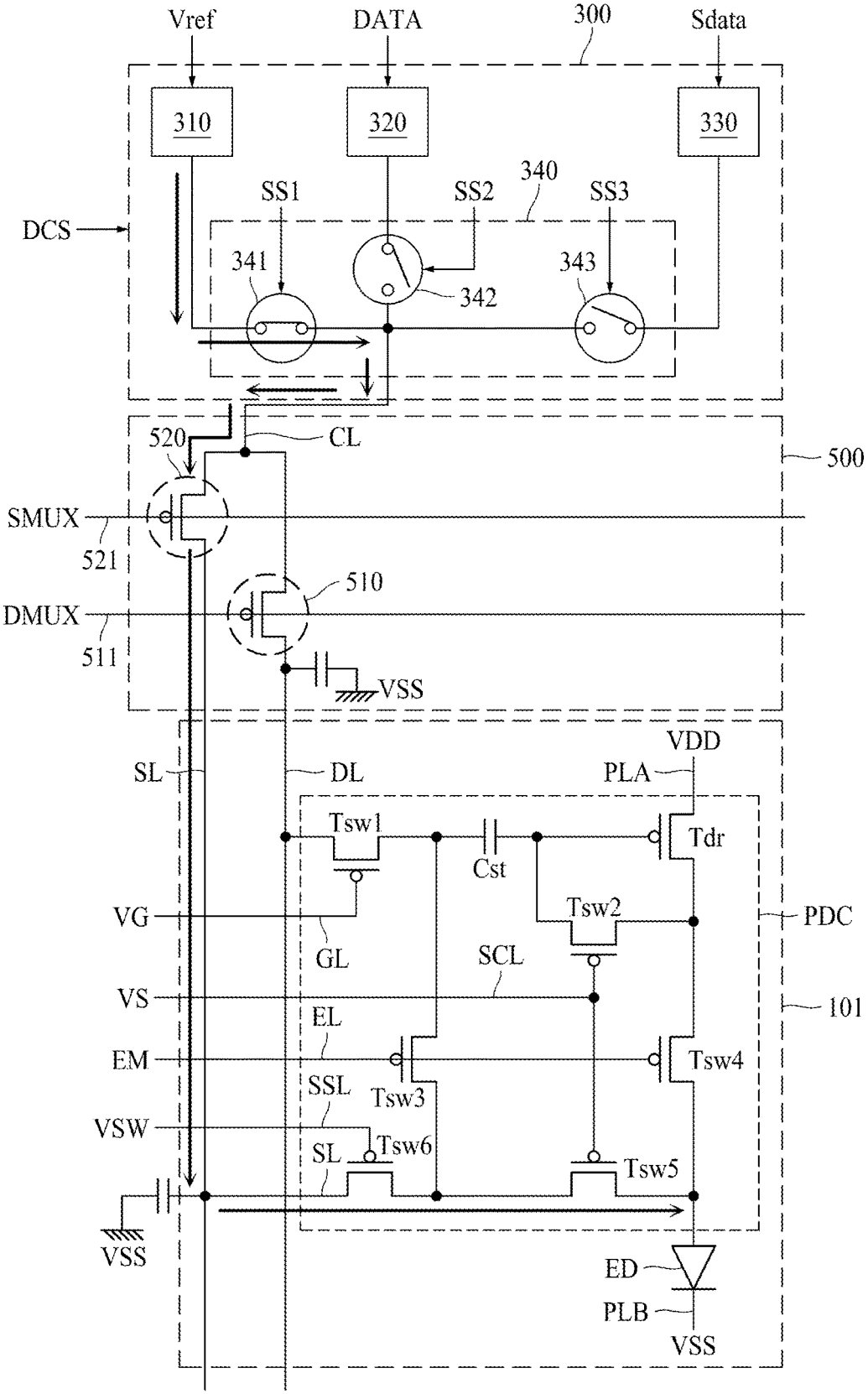
FIGS. 7 and 8 are diagrams for describing an operating method of a data driver and a switching driver illustrated in FIG. 5 on the basis of signals illustrated in FIG. 6.
Figure 8:
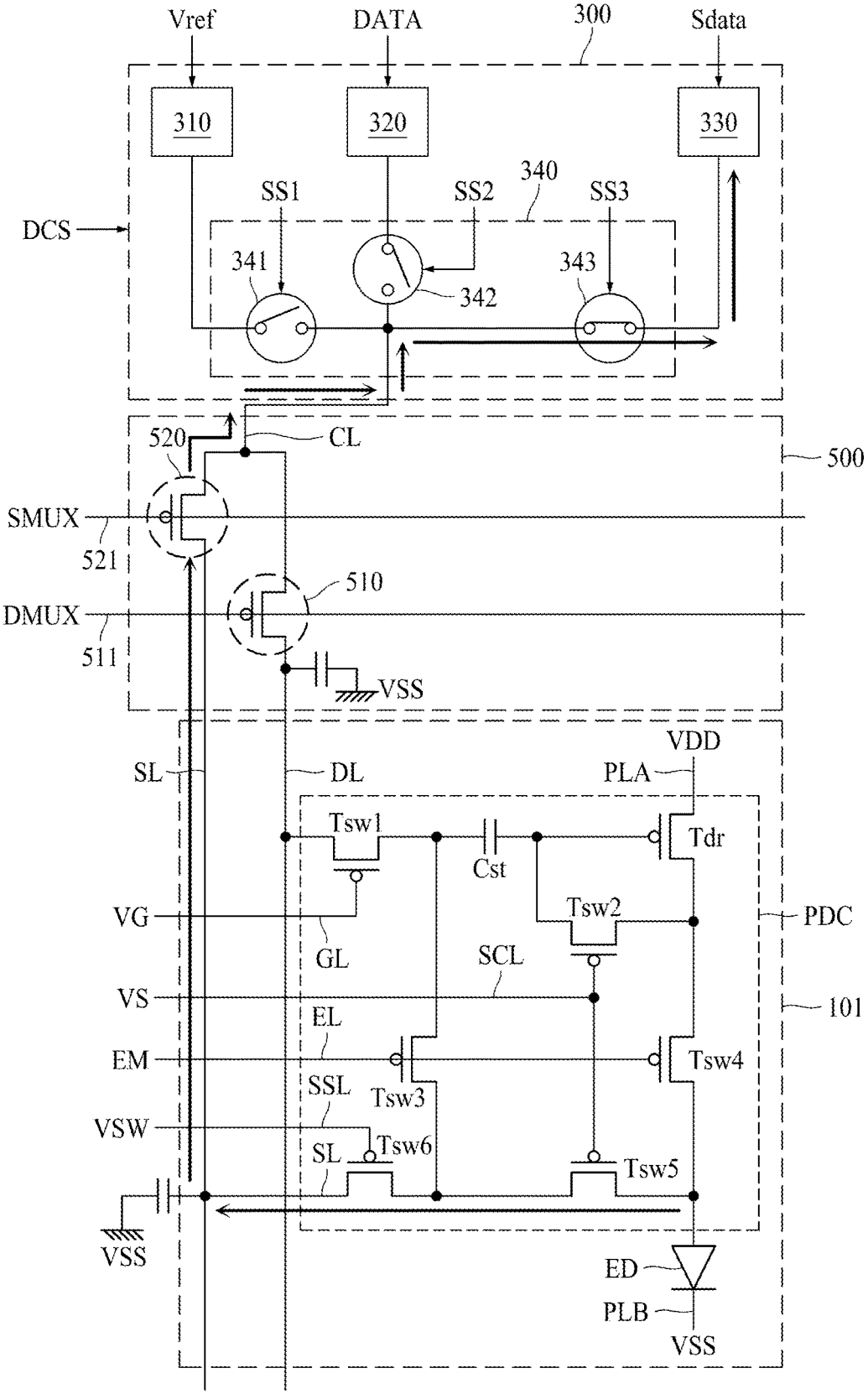

FIG. 6 is a diagram showing waveforms of applied signals in a light emitting device sensing period of a light emitting display apparatus according to an embodiment of the present disclosure, and FIGS. 7 and 8 are diagrams for describing an operating method of a data driver and a switching driver illustrated in FIG. 5 on the basis of signals illustrated in FIG. 6.

First, FIG. 7 is a diagram for describing an operating method of a data driver 300 and a switching driver 500 in a charging period CP of a light emitting device sensing period ESP where a characteristic change of a light emitting device is sensed.

First, when the charging period CP starts, the controller 400 may transfer a first switching control signal SS1 to a first switch 341 so that a connection line CL is connected to a reference voltage transferor 310, transfer a third switching control signal SS3 to a third switch 343 so that the connection line CL is disconnected from a converter 330, and transfer a second switching control signal SS2 to a second switch 342 so that the connection line CL is disconnected from a data voltage generator 320.

Therefore, the connection line CL may be connected to the reference voltage transferor 310 through the first switch 341.

Subsequently, the controller 400 may transfer a first control signal DMUX and a second control signal SMUX to a first signal line 511 and a second signal line 521 so that the first switching unit 510 is turned off and the second switching unit 520 is turned on.

Therefore, the sensing line SL may be connected to the connection line CL through the second switching unit 520, and the connection line CL may be connected to the data line DL through the first switching unit 510.

Subsequently, through the above-described processes, the sensing line SL may be connected to the reference voltage transferor 310.

Subsequently, the sensing line SL may be connected to the reference voltage transferor 310, and thus, a reference voltage Vref may be supplied from the reference voltage transferor 310 to a pixel through the sensing line SL.

In this case, a sensing switching transistor Tsw6 may be turned on by a sensing switching signal VSW and a sensing control transistor Tsw5 may be turned on by a sensing control signal VS, and thus, the reference voltage Vref transferred through the sensing line SL may be applied to a first terminal of a light emitting device ED through the sensing switching transistor Tsw6 and the sensing control transistor Tsw5. Also, a first transistor Tsw1, a third transistor Tsw3, and a fourth transistor Tsw4 may be turned off by a gate signal VG and an emission signal EM, and thus, a first voltage VDD may not be applied to the light emitting device ED.

Finally, as illustrated in FIG. 6, a voltage VED at the first terminal of the light emitting device ED may increase based on the reference voltage Vref applied to the first terminal of the light emitting device ED.

That is, in the charging period CP, an electric charge may be charged into the light emitting device ED on the basis of the reference voltage Vref applied to the light emitting device ED through the sensing line SL.

Second, FIG. 8 is a diagram for describing an operating method of a data driver 300 and a switching driver 500 in the sensing period SP of the light emitting device sensing period ESP where a characteristic change of a light emitting device is sensed.

First, while the sensing period SP is being executed, a sensing switching transistor Tsw6 and a sensing control transistor Tsw5 may maintain a turn-on state, and a first transistor Tsw1, a third transistor Tsw3, and a fourth transistor Tsw4 may maintain a turn-off state.

When the sensing period SP starts, the controller 400 may transfer a first switching control signal SS1 to the switching unit 340 so that the connection line CL is disconnected from a reference voltage transferor 310 and may transfer a second switching control signal SS2 to a second switch 342 so that the connection line CL is disconnected from a data voltage generator 320, and when a selected (or predetermined) time elapses after the connection line CL is disconnected from the reference voltage transferor 310, the controller 400 may transfer a third switching control signal SS3 to a third switch 343 so that the connection line CL is connected to a converter 330.

Therefore, the connection line CL may be connected to the converter 330 through the third switch 343.

Subsequently, the controller 400 may continuously transfer, to a first signal line 511 and a second signal line 521, a first control signal DMUX and a second control signal SMUX for turning off a first switching unit 510 and turning on a second switching unit 520.

Therefore, a sensing line SL may be connected to the connection line CL through the second switching unit 520.

Subsequently, through the above-described processes, the sensing line SL may be connected to the converter 330.

Subsequently, the sensing line SL may be connected to the converter 330, a sensing switching transistor Tsw6 may be turned on by a sensing switching signal VSW, and a sensing control transistor Tsw5 may be turned on by a sensing control signal VS, whereby electric charges charged into a first terminal of a light emitting device ED may be discharged through the sensing line SL.

Therefore, a voltage VED at the first terminal of the light emitting device ED may decrease as illustrated in FIG. 6.

Finally, at a time at which the third switch 343 is turned off by the third switching control signal SS3, the converter 330 may convert a sensing signal, sensed through the sensing line SL, into sensing data Sdata and may transfer the generated sensing data Sdata to the controller 400. The sensing signal may be a voltage applied to the first terminal of the light emitting device ED.

That is, a level of a threshold voltage of the light emitting device ED may be shifted based on the degree of degradation of the light emitting device ED, and when the level of the threshold voltage of the light emitting device ED varies, the amount of electric charges leaked through the light emitting device ED may vary for a selected (or predetermined) time and the amount of leaked electric charges may be proportional to a voltage.

Therefore, the magnitude of a characteristic change of the light emitting device ED (for example, the amount of variation of a threshold voltage of a light emitting device) may be determined by measuring a level of a voltage sensed in the converter 330.

To provide an additional description, an input unit 410 of the controller 400 may analyze the sensing data Sdata transferred from the converter 330 to sense the amount of variation of the threshold voltage of the light emitting device ED, and thus, the degree of degradation of the light emitting device ED may be determined.

The amount of variation of the threshold voltage calculated by the input unit 410 may be stored in the storage unit 450.

When the light emitting display apparatus is changed to a display mode and displays an image, the controller 400 may convert input video data into image data DATA on the basis of the amount of variation of the threshold voltage stored in the storage unit 450, vary a level of a first voltage VDD on the basis of the amount of variation of the threshold voltage, and vary a level of the reference voltage Vref on the basis of the amount of variation of the threshold voltage.

That is, the amount of variation of the threshold voltage of the light emitting device ED determined through the above-described processes may be applied to various compensation methods which are performed when the light emitting display apparatus is driven in the display mode.

For example, in the display mode where the light emitting display apparatus displays an image, compensation (hereinafter simply referred to as external compensation) for varying a level of the image data DATA may be performed so as to compensate for a characteristic change caused by a degradation in the driving transistor Tdr included in the pixel 101. Also, in the display mode, compensation (hereinafter simply referred to as internal compensation) for preventing a threshold voltage of the driving transistor from adversely affecting the luminance of the light emitting device may be performed for preventing a characteristic change (for example, a variation of a threshold voltage), caused by a degradation in the driving transistor Tdr, from adversely affecting the luminance of the light emitting device.

However, in a case where the threshold voltage of the light emitting device varies due to a degradation in the light emitting device ED, when external compensation or internal compensation is performed without considering the amount of variation of the threshold voltage of the light emitting device, luminance accurately corresponding to a data voltage may not occur.

Therefore, when the external compensation or the internal compensation is performed, the controller may more completely perform the external compensation or the internal compensation on the basis of the amount of characteristic change (for example, the amount of variation of a threshold voltage) of the light emitting device ED calculated through the above-described process, thereby enhancing the quality of the light emitting display apparatus.

A compensation method performed by using the amount of characteristic change (for example, the amount of variation of a threshold voltage) of the light emitting device ED calculated according to the present disclosure may be variously changed based on a characteristic and function of the light emitting display apparatus, and such a compensation method may be one of various compensation methods performed currently. Also, the above-described compensation methods may not be an essential feature of the present disclosure. That is, the present disclosure may be used to calculate the amount of characteristic change of the light emitting device ED capable of being applied to the above-described compensation methods. Therefore, detailed descriptions of the above-described compensation methods are omitted.

In this case, the above-described processes of calculating the amount of characteristic change of the light emitting device ED may be automatically performed at every selected (or predetermined) period when the light emitting display apparatus is used by a user, may be performed in performing a process of repairing the light emitting display apparatus, or may be performed in performing a processing of manufacturing the light emitting display apparatus.

For example, in a case where the light emitting display apparatus is used by the user, the processes described above with reference to FIGS. 6 to 8 may be performed at every one month, one year, or 1,000 hours, and the amount of characteristic change of the light emitting device calculated by the processes may be stored in the storage unit 450. In this case, the processes may be performed when the light emitting display apparatus is turned on or off, on the basis of control by the controller 400 or control by the external system. Subsequently, when the light emitting display apparatus is driven in the display mode, the controller 400 may perform the internal compensation or the external compensation by using the amount of characteristic change of the light emitting device stored in the storage unit 450, and thus, the image quality of the light emitting display apparatus may be continuously maintained.

As another example, the processes described above with reference to FIGS. 6 to 8 may be performed in performing a process of repairing the light emitting display apparatus or a process of manufacturing the light emitting display apparatus, and the amount of characteristic change of the light emitting device calculated by the processes may be stored in the storage unit 450. Subsequently, when the light emitting display apparatus is driven in the display mode, the controller 400 may perform the internal compensation or the external compensation by using the amount of characteristic change of the light emitting device stored in the storage unit 450, and thus, the image quality of the light emitting display apparatus may be continuously maintained.

That is, it may be determined to be beneficial that the processes described above with reference to FIGS. 6 to 8 be performed, and thus, when a user, a repairer, or a manufacturer operates the controller 400 in a light emitting device sensing mode or the controller 400 is automatically driven in a selected (or predetermined) period, the processes described above with reference to FIGS. 6 to 8 may be performed.

Figure 9:
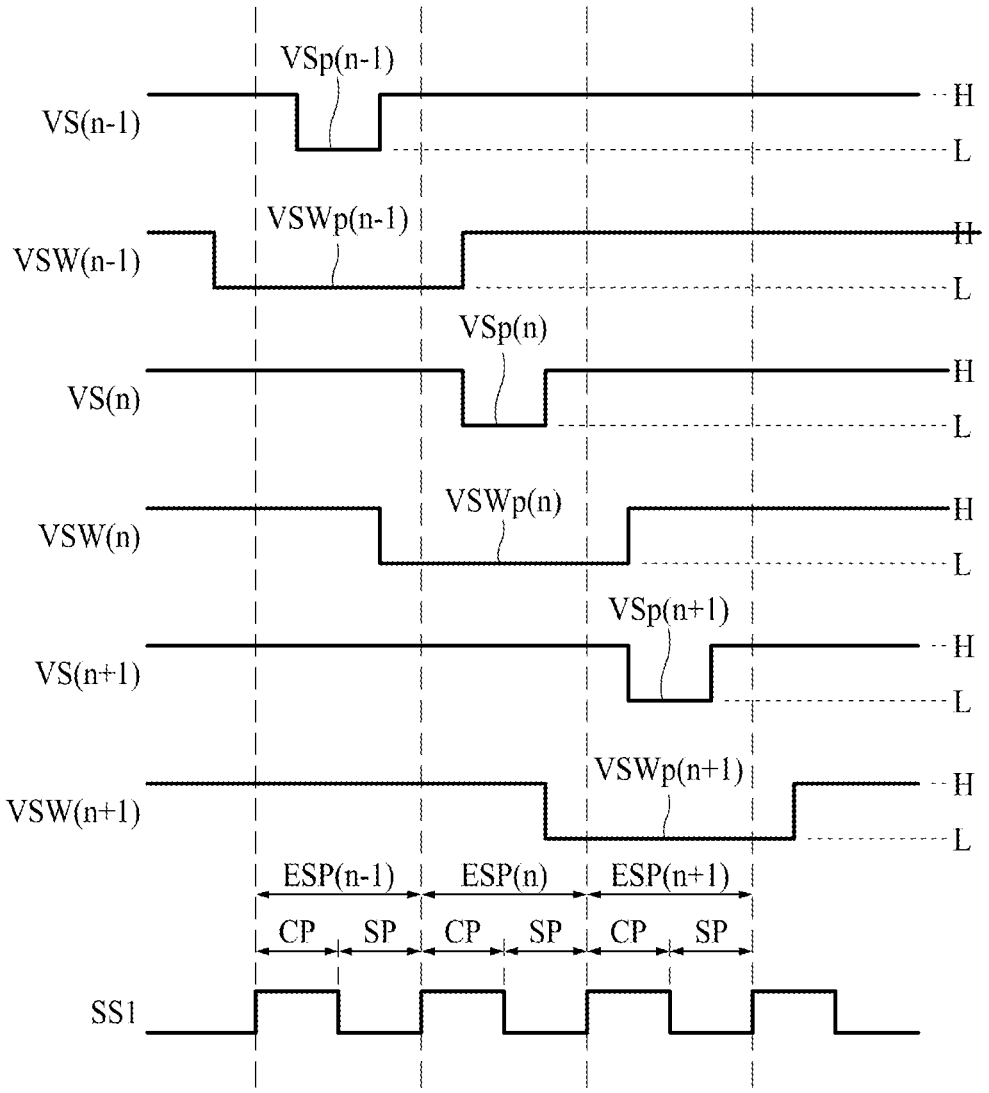
FIG. 9 is another diagram showing waveforms of applied signals in a light emitting device sensing period of a light emitting display apparatus according to an embodiment of the present disclosure.
Figure 10:
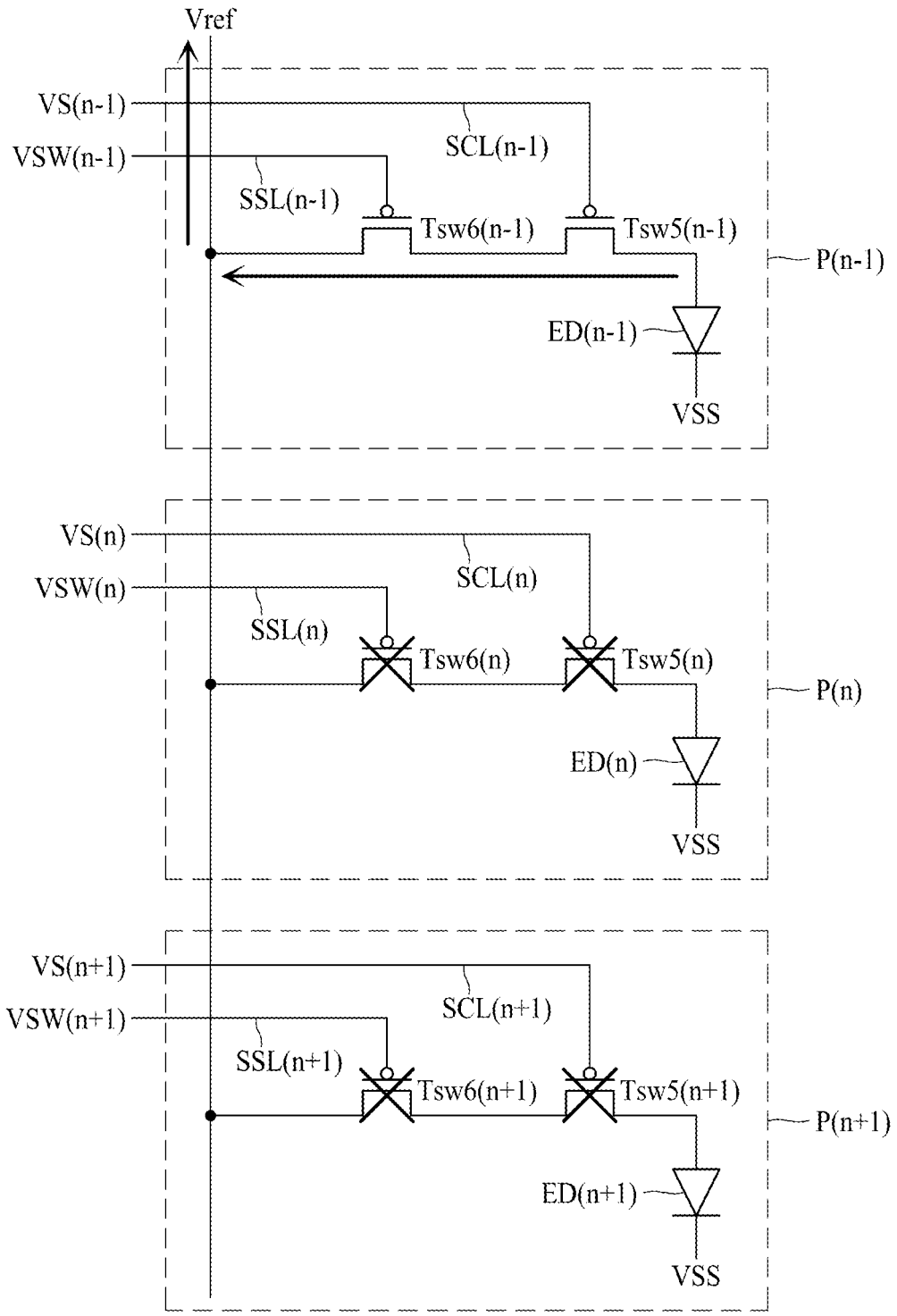
FIGS. 10 to 12 are diagrams for describing an operating method of a pixel driving circuit illustrated in FIGS. 2 and 5 on the basis of signals illustrated in FIG. 9.
Figure 11:
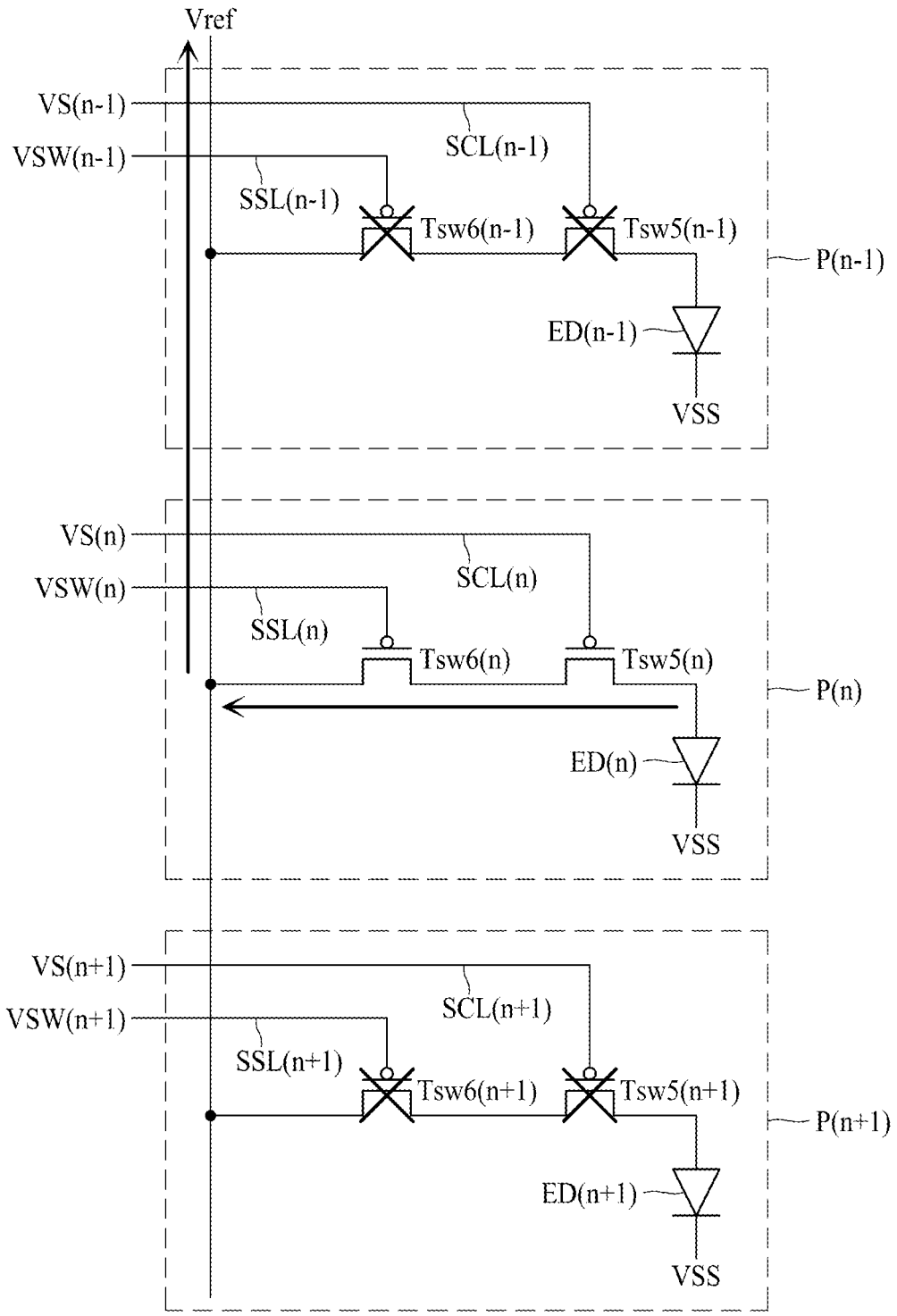
Figure 12:
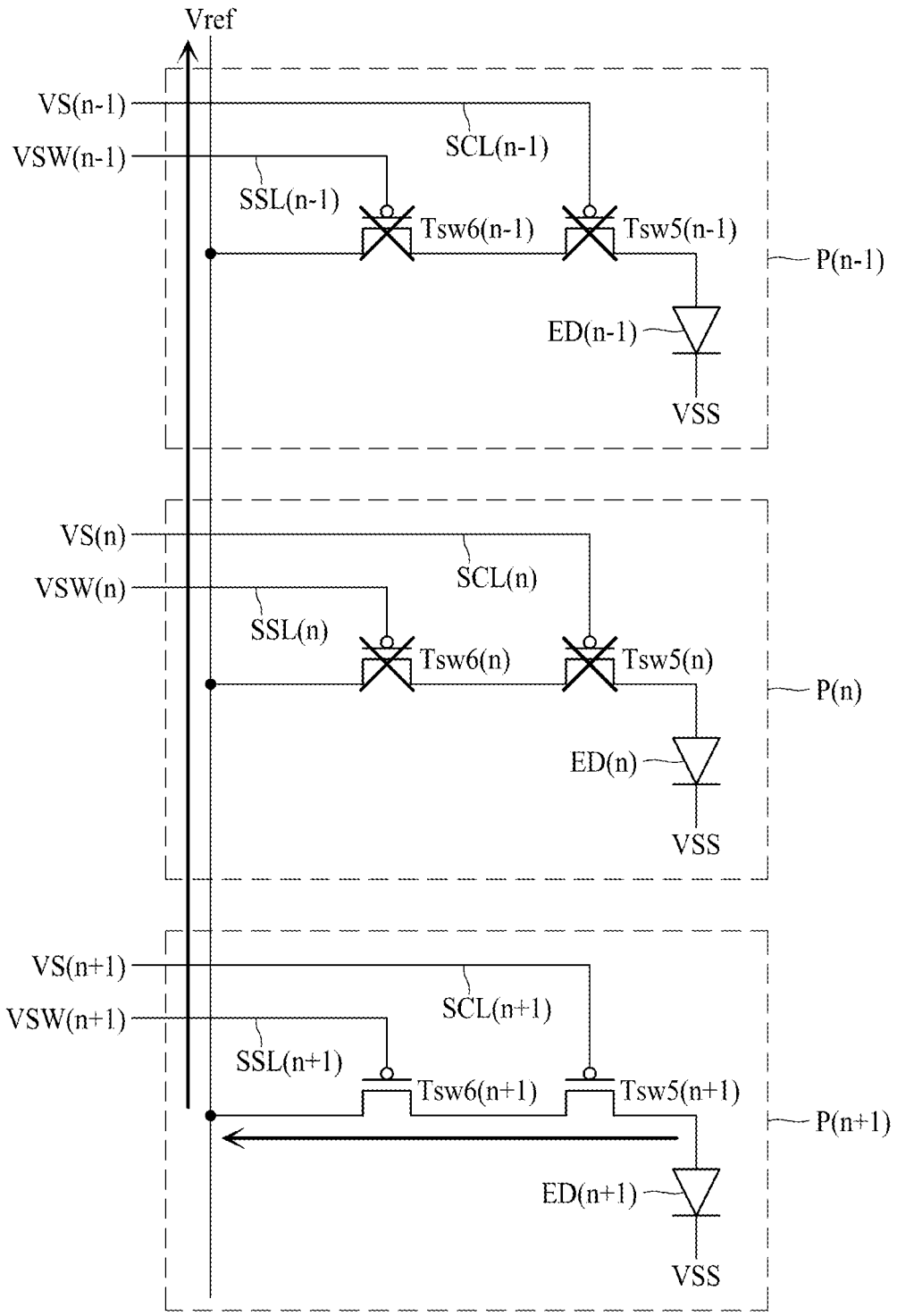

FIG. 9 is another diagram showing waveforms of applied signals in a light emitting device sensing period of a light emitting display apparatus according to an embodiment of the present disclosure, and FIGS. 10 to 12 are diagrams for describing an operating method of a pixel driving circuit illustrated in FIGS. 2 and 5 on the basis of signals illustrated in FIG. 9.

Particularly, waveforms of sensing control signals VS(n−1), VS(n), and VS(n+1) and sensing switching signals VSW(n−1), VSW(n), and VSW(n+1) supplied to pixels connected to an $n-1^{th}$ gate line GLn−1, an $n^{th}$ gate line GLn, and an $n+1^{th}$ gate line GLn+1 are shown in FIG. 9.

Moreover, an $n-1^{th}$ pixel P(n−1) connected to the $n-1^{th}$ gate line GLn−1, an $n^{th}$ pixel P(n) connected to the $n^{th}$ gate line GLn, and an $n+1^{th}$ pixel P(n+1) connected to the $n+1^{th}$ gate line GLn+1 are illustrated in FIGS. 10 to 12.

Moreover, FIG. 10 illustrates a method of sensing a characteristic change of a light emitting device ED included in the $n-1^{th}$ pixel P(n−1), FIG. 11 illustrates a method of sensing a characteristic change of a light emitting device ED included in the $n^{th}$ pixel P(n), and FIG. 12 illustrates a method of sensing a characteristic change of a light emitting device ED included in the $n+1^{th}$ pixel P(n+1).

In this case, for convenience of description, only the sensing control transistor Tsw5 and the sensing switching transistor Tsw6 among transistors configuring the pixel driving circuit illustrated in FIGS. 2 and 5 are illustrated in each of the pixels P(n−1), P(n), and P(n+1) illustrated in FIGS. 10 to 12.

In the following description, a signal, turning on the sensing control transistor Tsw5, of the sensing control signal VS may be referred to as a sensing control pulse VSp, and a signal, turning off the sensing control transistor Tsw5, of the sensing control signal VS may be referred to as a sensing control off signal. Also, a signal, turning on the sensing switching transistor Tsw6, of the sensing switching signal VSW may be referred to as a sensing switching pulse VSWp, and a signal, turning off the sensing switching transistor Tsw6, of the sensing switching signal VSW may be referred to as a sensing switching off signal.

In this case, in FIG. 9, the sensing control pulse VSp and the sensing switching pulse VSWp may be signals having a low level L, and the sensing control off signal and the sensing switching off signal may be signals having a high level H.

That is, as illustrated in FIGS. 2 and 5, when transistors configuring the pixel driving circuit PDC are configurated as a P type, the transistors may be turned on by a signal having the low level L and may be turned off by a signal having the high level H.

Therefore, the sensing control transistor Tsw5 and the sensing switching transistor Tsw6 may be turned on by the sensing control pulse VSp and the sensing switching pulse VSWp having the low level L, and the sensing control transistor Tsw5 and the sensing switching transistor Tsw6 may be turned off by the sensing control off signal and the sensing switching off signal having the high level H.

In the following description, descriptions which are the same as or similar to descriptions given above with reference to FIGS. 5 to 8 are omitted or will be briefly given.

The light emitting display apparatus according to the present disclosure may display an image by using the internal compensation or the external compensation in the display mode. Particularly, the light emitting display apparatus including the pixel driving circuit PDC illustrated in FIGS. 2 and 4 may use the internal compensation.

Generally, a current flowing in the light emitting device ED may be proportional to the square of a difference voltage (=Vgs−Vth) between a gate-source voltage Vgs of the driving transistor Tdr and a threshold voltage Vth of the driving transistor Tdr. That is, an equation ($=k(Vgs-Vth)^2$) of calculating the current flowing in the light emitting device ED may include the threshold voltage Vth (where k is a proportional constant).

The internal compensation may be a method of variously varying a voltage at each of a source, a drain, and a gate of the driving transistor Tdr so as to remove a threshold voltage Vth item from the equation of calculating the current flowing in the light emitting device ED. That is, in the light emitting display apparatus using the internal compensation, because the threshold voltage Vth item is removed from the equation of calculating the current flowing in the light emitting device ED, a level of the current flowing in the light emitting device ED may not be based on the threshold voltage Vth of the driving transistor Tdr. Accordingly, even when the threshold voltage Vth of the driving transistor Tdr is shifted due to a degradation in the driving transistor Tdr, the light emitting device ED may emit light having luminance corresponding to the data voltage Vdata.

A feature of the present disclosure is irrelevant to the internal compensation, and thus, a detailed description of a detailed method associated with the internal compensation is omitted.

Moreover, in the present disclosure, the sensing control transistor Tsw5 and the sensing switching transistor Tsw6 connected between the light emitting device ED and the sensing line SL among the transistors configuring the pixel driving circuit PDC may be beneficial.

Therefore, in the pixel driving circuit PDC illustrated in FIGS. 2 and 5, a connection structure between transistors other than the sensing control transistor Tsw5 and the sensing switching transistor Tsw6 may be variously modified based on a detailed method of the internal compensation or a detailed method of the external compensation.

In a case where a selected (or predetermined) period for sensing the light emitting device arrives while the light emitting display apparatus is being used by a user, sensing on the light emitting device should be performed in a process of repairing the light emitting display apparatus, or sensing on the light emitting device should be performed in a process of manufacturing the light emitting display apparatus, the light emitting display apparatus may change the display mode to a light emitting device sensing mode ESP, and thus, the light emitting device sensing mode ESP may start.

That is, the changing of a display mode to the light emitting device sensing mode may be automatically performed, or a request signal which issues a request to change a mode to the light emitting device sensing mode may be input to the controller 400 by a user, a repairer, or a manufacturer and thus may be performed.

First, a sensing method performed on an $n-1^{th}$ light emitting device ED(n−1) included in an $n-1^{th}$ pixel P(n−1) connected to an $n-1^{th}$ gate line GLn−1 will be described with reference to FIGS. 9 and 10.

First, in the light emitting device sensing mode, when an $n-1^{th}$, light emitting device sensing period ESP(n−1) starts where sensing is performed on the $n-1^{th}$ light emitting device ED(n−1) included in the $n-1^{th}$ pixel P(n−1) connected to the $n-1^{th}$ gate line GLn−1, as illustrated in FIG. 9, an $n-1^{th}$ sensing switching signal VSW(n−1) (e.g., an $n-1^{th}$ sensing switching pulse VSWp(n−1)) having a low level L may be supplied to an $n-1^{th}$ sensing switching transistor Tsw6(*n*−1) included in the $n-1^{th}$ pixel P(n−1).

In this case, the $n-1^{th}$ sensing switching pulse VSWp(n−1) may be supplied to the $n-1^{th}$ sensing switching transistor Tsw6(*n*−1) from before a first switching control signal SS1 having a high level is supplied to the data driver 300.

Subsequently, before an $n-1^{th}$ sensing control pulse VSp(n−1) having a low level L is supplied to an $n-1^{th}$ sensing control line SCL(n−1) after the $n-1^{th}$ sensing switching pulse VSWp(n−1) is supplied to an $n-1^{th}$ sensing switching line SSL(n−1), as described above with reference to FIGS. 5 to 8, the switching unit 340 and the switching driver 500 may connect the reference voltage transferor 310 to the sensing line SL.

That is, as illustrated in FIGS. 6 and 9, when a charging period CP of the light emitting device sensing period ESP starts, the controller 400 may supply the switching unit 340 with the first switching control signal SS1 which connects the connection line CL to the reference voltage transferor 310. In this case, the sensing line SL may be connected to the switching unit 340 by the second control signal SMUX supplied to the switching driver 500.

Subsequently, the $n-1^{th}$ sensing switching pulse VSWp(n−1) having the low level L may be supplied to an $n-1^{th}$ sensing switching line SSL(n−1) and the first switching control signal SS1 having a high level may be supplied to the switching unit 340, and then, the $n-1^{th}$ sensing control pulse VSp(n−1) having the low level L may be supplied to the $n-1^{th}$ sensing control line SCL(n−1).

Therefore, all of an $n-1^{th}$ sensing control transistor Tsw5(*n*−1) and an $n-1^{th}$ sensing switching transistor Tsw6(*n*−1) may be turned on, as illustrated in FIG. 10, a first terminal of an $n^{th}$ light emitting device ED(n) may be electrically connected to the sensing line SL.

That is, in the charging period CP, the reference voltage transferor 310 may be connected to the sensing line SL by the first switching control signal SS1 and the second control signal SMUX, and a first terminal of an $n-1^{th}$ light emitting device ED(n−1) may be electrically connected to the sensing line SL by the $n-1^{th}$ sensing switching pulse VSWp(n−1) and the $n-1^{th}$ sensing control pulse VSp(n−1).

Therefore, an electric charge may be charged into the first terminal of the $n-1^{th}$ light emitting device ED(n−1) included in the $n-1^{th}$ pixel P(n−1).

Finally, the switching unit 340 may connect the converter 330 to the sensing line SL until before the supply of the $n-1^{th}$ sensing switching pulse VSWp(n−1) stops from before the supply of the $n-1^{th}$ sensing control pulse VSp(n−1) stops.

That is, the converter 330 may be connected to the sensing line SL in the sensing period SP, and thus, the converter 330 may receive a sensing signal transferred through the sensing line SL and may convert the sensing signal into the sensing data Sdata.

Accordingly, in some embodiments, in the sensing period SP, as described above with reference to FIGS. 5 to 8, the third switching control signal SS3 may be supplied to the switching unit 340 so that the connection line CL connected to the sensing line SL is connected to the converter 330.

For example, when a pulse width of the first switching control signal SS1 having the high level H supplied to the switching unit 340 in the charging period CP is a one-horizontal period (hereinafter simply referred to as 1H), a width of the $n-1^{th}$ sensing control pulse VSp(n−1) may be 1H, and a width of the $n-1^{th}$ sensing switching pulse VSWp(n−1) may be 3H which is three times 1H.

In the processes, when only an electric charge charged into the $n-1^{t}$ light emitting device ED(n−1) included in the $n-1^{th}$ pixel P(n−1) is transferred to the converter 330, a characteristic change of the $n-1^{th}$ light emitting device ED(n−1) included in the $n-1^{th}$ pixel P(n−1) may be accurately measured.

A period, where an electric charge charged into the $n-1^{th}$ light emitting device ED(n−1) included in the $n-1^{th}$ pixel P(n−1) is transferred to the converter 330, may be a period where the $n-1^{th}$ sensing control transistor Tsw5(*n*−1) and the $n-1^{th}$ sensing switching transistor Tsw6(*n*−1) included in the $n-1^{th}$ pixel P(n−1), and particularly, may be a period where the $n-1^{th}$ sensing control transistor Tsw5(*n*−1) is turned on.

Therefore, the $n^{th}$ pixel P(n) and the $n+1^{th}$ pixel P(n+1) should be electrically disconnected from the sensing line SL while the electric charge charged into the $n-1^{th}$ light emitting device ED(n−1) is being transferred to the converter 330 through the sensing line SL, so that only the electric charge charged into the $n-1^{th}$ light emitting device ED(n−1) included in the $n-1^{th}$ pixel P(n−1) is transferred to the converter 330 through the sensing line SL.

Accordingly, in some embodiments, in the present disclosure, as illustrated in FIG. 9, when the $n-1^{th}$ sensing control pulse VSp(n−1) is supplied to the $n-1^{th}$ sensing control line SCL(n−1) connected to the $n-1^{th}$ pixel P(n−1) connected to the $n-1^{th}$ gate line GLn−1, sensing switching off signals for turning off sensing switching transistors Tsw6(*n*) and Tsw6(*n*+1) connected to the $n^{th}$ sensing switching line SSL(n) and the $n+1^{th}$ sensing switching line SSL (n+1) may be supplied to the $n^{th}$ sensing switching line SSL(n) connected to the $n^{th}$ pixel P(n) connected to the $n^{th}$ gate line GLn and the $n+1^{th}$ sensing switching line SSL(n+1) connected to the $n+1^{th}$ pixel P(n+1) connected to the $n+1^{th}$ gate line GLn+1.

Moreover, when the $n-1^{th}$ sensing control pulse VSp(n−1) is supplied to the $n-1^{th}$ sensing control line SCL(n−1), sensing control off signals for turning off sensing switching transistors Tsw5(*n*) and Tsw5(*n*+1) connected to the $n^{th}$ sensing control line SCL(n) and the $n+1^{th}$ sensing control line SCL(n+1) may be supplied to the $n^{th}$ sensing control line SCL(n) connected to the $n^{th}$ pixel P(n) and the $n+1^{th}$ sensing control line SCL(n+1) connected to the $n+1^{th}$ pixel P(n+1).

That is, as illustrated in FIG. 9, when the $n-1^{th}$ sensing control pulse VSp(n−1) is supplied to the $n-1^{th}$ pixel P(n−1), an $n^{th}$ sensing switching signal VSW(n) and an $n+1^{th}$ sensing switching signal VSW(n+1) may have the high level H, and an $n^{th}$ sensing control signal VS(n) and an $n+1^{th}$ sensing control signal VS(n+1) may have the high level H.

Therefore, all of the $n^{th}$ sensing switching transistor Tsw6(*n*) to which an $n^{th}$ sensing switching signal VSW(n) is supplied, the $n+1^{th}$ sensing switching transistor Tsw6(*n*+1) to which an $n+1^{th}$ sensing switching signal VSW(n+1) is supplied, the $n^{th}$ sensing control transistor Tsw5(*n*) to which an $n^{th}$ sensing control signal VS(n) is supplied, and the $n+1^{th}$ sensing control transistor Tsw5(*n*+1) to which an $n+1^{th}$ sensing control signal VS(n+1) is supplied may be turned off.

Therefore, electric charges leaked from the $n^{th}$ light emitting device ED(n) included in the $n^{th}$ pixel P(n) and the $n+1^{th}$ light emitting device ED(n+1) included in the $n+1^{th}$ pixel P(n+1) may not be transferred to the sensing line SL.

Therefore, only an electric charge transferred from the $n-1^{th}$ light emitting device ED(n−1) included in the $n-1^{th}$ pixel P(n−1) may be transferred to the converter 330 through the sensing line SL, and thus, only a characteristic change of the $n-1^{th}$ light emitting device ED(n−1) included in the $n-1^{th}$ pixel P(n−1) may be measured in an $n-1^{th}$ light emitting device sensing period ESP(n−1).

That is, according to the present disclosure described above, a characteristic change of a light emitting device which is to be sensed may be accurately measured, and thus, various functions for compensating for a characteristic change of the light emitting device may be accurately performed.

In this case, as described above, a width of the $n-1^{th}$ sensing switching pulse VSWp(n−1) supplied to the $n-1^{th}$ sensing switching line SSL(n−1) for turning on the $n-1^{th}$ sensing switching transistor Tsw6(*n*−1) may be greater than that of the $n-1^{th}$ sensing control pulse VSp(n−1) supplied to the $n-1^{th}$ sensing control line SCL(n−1) for turning on the $n-1^{th}$ sensing control transistor Tsw5(*n*−1). For example, when a width of the $n-1^{th}$ sensing switching pulse VSWp (n−1) is 3H, a width of the $n-1^{th}$ sensing control pulse VSp(n−1) may be 1H.

Moreover, the $n-1^{th}$ sensing switching pulse VSWp(n−1) may be supplied to the $n-1^{th}$ sensing switching line SSL(n−1), and then, the $n-1^{th}$ sensing control pulse VSp(n−1) may be supplied to the $n-1^{th}$ sensing control line SCL(n−1).

Second, a sensing method performed on an $n^{th}$ light emitting device ED(n) included in an $n^{th}$ pixel P(n) connected to an $n^{th}$ gate line GLn will be described with reference to FIGS. 9 and 11. In the following description, descriptions which are the same as or similar to descriptions given above with reference to FIGS. 9 and 10 are omitted or will be briefly given.

First, in the light emitting device sensing mode, when an $n^{th}$ light emitting device sensing period ESP(n) starts where sensing is performed on the $n^{th}$ light emitting device ED(n) included in the $n^{th}$ pixel P(n) connected to the $n^{th}$ gate line GLn, as illustrated in FIG. 9, an $n^{th}$ sensing switching signal VSW(n) (e.g., an $n^{th}$ sensing switching pulse VSWp(n)) having the low level L may be supplied to an $n^{th}$ sensing switching transistor Tsw6(*n*) included in the $n^{th}$ pixel P(n).

In this case, the $n^{th}$ sensing switching pulse VSWp(n) may be supplied to the $n^{th}$ sensing switching transistor Tsw6(*n*) from before the first switching control signal SS1 having a high level is supplied to the data driver 300.

Subsequently, before an $n^{th}$ sensing control pulse VSp(n) having the low level L is supplied to an $n^{th}$ sensing switching line SSL(n) after the $n^{th}$ sensing switching pulse VSWp(n) is supplied to an $n^{th}$ sensing switching line SSL(n), as described above with reference to FIGS. 5 to 8, the switching unit 340 and the switching driver 500 may connect the reference voltage transferor 310 to the sensing line SL.

Subsequently, the $n^{th}$ sensing switching pulse VSWp(n) having the low level L may be supplied to an $n^{th}$ sensing switching line SSL(n) and the first switching control signal SS1 having a high level may be supplied to the switching unit 340, and then, the $n^{th}$ sensing control pulse VSp(n) having the low level L may be supplied to the $n^{th}$ sensing control line SCL(n).

Therefore, all of an $n^{th}$ sensing control transistor Tsw5(*n*) and an $n^{th}$ sensing switching transistor Tsw6(*n*) may be turned on, as illustrated in FIG. 11, the first terminal of the $n^{th}$ light emitting device ED(n) may be electrically connected to the sensing line SL.

That is, in the charging period CP, the reference voltage transferor 310 may be connected to the sensing line SL by the first switching control signal SS1 and the second control signal SMUX, and the first terminal of the $n^{th}$ light emitting device ED(n) may be electrically connected to the sensing line SL by the $n^{th}$ sensing switching pulse VSWp(n) and the $n^{th}$ sensing control pulse VSp(n).

Therefore, an electric charge may be charged into the first terminal of the $n^{th}$ light emitting device ED(n) included in the $n^{th}$ pixel P(n).

Finally, the switching unit 340 may connect the converter 330 to the sensing line SL until before the supply of the $n^{th}$ sensing switching pulse VSWp(n) stops from before the supply of the $n^{th}$ sensing control pulse VSp(n) stops.

That is, the converter 330 may be connected to the sensing line SL in the sensing period SP, and thus, the converter 330 may receive a sensing signal transferred through the sensing line SL and may convert the sensing signal into the sensing data Sdata.

Accordingly, in some embodiments, in the sensing period SP, as described above with reference to FIGS. 5 to 8, the third switching control signal SS3 may be supplied to the switching unit 340 so that the connection line CL connected to the sensing line SL is connected to the converter 330.

In the processes, when only an electric charge charged into the $n^{th}$ light emitting device ED(n) included in the $n^{th}$ pixel P(n) is transferred to the converter 330, a characteristic change of the $n^{th}$ light emitting device ED(n) included in the $n^{th}$ pixel P(n) may be accurately measured.

A period, where an electric charge charged into the $n^{th}$ light emitting device ED(n) included in the $n^{th}$ pixel P(n) is transferred to the converter 330, may be a period where the $n^{th}$ sensing control transistor Tsw5(*n*) and the $n^{th}$ sensing switching transistor Tsw6(*n*) included in the $n^{th}$ pixel P(n), and particularly, may be a period where the $n^{th}$ sensing control transistor Tsw5(*n*) is turned on.

Therefore, the $n-1^{th}$ pixel P(n−1) and the $n+1^{th}$ pixel P(n+1) should be electrically disconnected from the sensing line SL while the electric charge charged into the $n^{th}$ light emitting device ED(n) is being transferred to the converter 330 through the sensing line SL, so that only the electric charge charged into the $n^{th}$ light emitting device ED(n) included in the $n^{th}$ pixel P(n) is transferred to the converter 330 through the sensing line SL.

Accordingly, in some embodiments, in the present disclosure, as illustrated in FIG. 9, when the $n^{th}$ sensing control pulse VSp(n) is supplied to the $n^{th}$ sensing control line SCL(n) connected to the $n^{th}$ pixel P(n) connected to the $n^{th}$ gate line GLn, sensing switching off signals for turning off sensing switching transistors Tsw6(*n*−1) and Tsw6(*n*+1) connected to the $n-1^{th}$ sensing switching line SSL(n−1) and the $n+1^{th}$ sensing switching line SSL(n+1) may be supplied to the $n-1^{th}$ sensing switching line SSL(n−1) connected to the $n-1^{th}$ pixel P(n−1) connected to the $n-1^{th}$ gate line GLn−1 and the $n+1^{th}$ sensing switching line SSL(n+1) connected to the $n+1^{th}$ pixel P(n+1) connected to the $n+1^{th}$ gate line GLn+1.

Moreover, when the $n^{th}$ sensing control pulse VSp(n) is supplied to the $n^{th}$ sensing control line SCL(n), sensing control off signals for turning off sensing switching transistors Tsw5(*n*) and Tsw5(*n*+1) connected to the $n-1^{th}$ sensing control line SCL(n−1) and the $n+1^{th}$ sensing control line SCL(n+1) may be supplied to the $n-1^{th}$ sensing control line SCL(n−1) connected to the $n-1^{th}$ pixel P(n−1) and the $n+1^{th}$ sensing control line SCL(n+1) connected to the $n+1^{th}$ pixel P(n+1).

That is, as illustrated in FIG. 9, when the $n^{th}$ sensing control pulse VSp(n) is supplied to the $n^{th}$ pixel P(n), an $n-1^{th}$ sensing switching signal VSW(n−1) and an $n+1^{th}$ sensing switching signal VSW(n+1) may have the high level H, and an $n-1^{th}$ sensing control signal VS(n−1) and an $n+1^{th}$ sensing control signal VS(n+1) may have the high level H.

Therefore, all of the $n-1^{th}$ sensing switching transistor Tsw6(*n*−1) to which an $n-1^{th}$ sensing switching signal VSW(n−1) is supplied, the $n+1^{th}$ sensing switching transistor Tsw6(*n*+1) to which an $n+1^{th}$ sensing switching signal VSW(n+1) is supplied, the $n-1^{th}$ sensing control transistor Tsw5(*n*−1) to which an $n-1^{th}$ sensing control signal VS(n−1) is supplied, and the $n+1^{th}$ sensing control transistor Tsw5(*n*+1) to which an $n+1^{th}$ sensing control signal VS(n+1) is supplied may be turned off.

Therefore, electric charges leaked from the $n-1^{th}$ light emitting device ED(n−1) included in the $n-1^{th}$ pixel P(n−1) and the $n+1^{th}$ light emitting device ED(n+1) included in the $n+1^{th}$ pixel P(n+1) may not be transferred to the sensing line SL.

Therefore, only an electric charge transferred from the $n^{th}$ light emitting device ED(n) included in the $n^{th}$ pixel P(n) may be transferred to the converter 330 through the sensing line SL, and thus, only a characteristic change of the $n^{th}$ light emitting device ED(n) included in the $n^{th}$ pixel P(n) may be measured in an $n^{th}$ light emitting device sensing period ESP(n).

That is, according to the present disclosure described above, a characteristic change of a light emitting device may be accurately measured, and thus, various functions for compensating for a characteristic change of the light emitting device may be accurately performed.

Third, a sensing method performed on an $n+1^{th}$ light emitting device ED(n+1) included in an $n+1^{th}$ pixel P(n+1) connected to an $n+1^{th}$ gate line GLn+1 will be described with reference to FIGS. 9 and 12. In the following description, descriptions which are the same as or similar to descriptions given above with reference to FIGS. 9 to 11 are omitted or will be briefly given.

First, in the light emitting device sensing mode, when an $n+1^{th}$ light emitting device sensing period ESP(n+1) starts where sensing is performed on the $n+1^{th}$ light emitting device ED(n+1) included in the $n+1^{th}$ pixel P(n+1) connected to the $n+1^{th}$ gate line GLn+1, as illustrated in FIG. 9, an $n+1^{th}$ sensing switching signal VSW(n+1) (e.g., an $n+1^{th}$ sensing switching pulse VSWp(n+1)) having the low level L may be supplied to an $n+1^{th}$ sensing switching transistor Tsw6(*n*+1) included in the $n+1^{th}$ pixel P(n+1).

In this case, the $n+1^{th}$ sensing switching pulse VSWp(n+1) may be supplied to the $n+1^{th}$ sensing switching transistor Tsw6(*n*+1) from before the first switching control signal SS1 having a high level is supplied to the data driver 300.

Subsequently, before an $n+1^{th}$ sensing control pulse VSp(n+1) having the low level L is supplied to an $n+1^{th}$ sensing switching line SSL(n+1) after the $n+1^{th}$ sensing switching pulse VSWp(n+1) is supplied to an $n+1^{th}$ sensing switching line SSL(n+1), as described above with reference to FIGS. 5 to 8, the switching unit 340 and the switching driver 500 may connect the reference voltage transferor 310 to the sensing line SL.

Subsequently, the $n+1^{th}$ sensing switching pulse VSWp(n+1) having the low level L may be supplied to an $n+1^{th}$ sensing switching line SSL(n+1) and the first switching control signal SS1 having a high level may be supplied to the switching unit 340, and then, the $n+1^{th}$ sensing control pulse VSp(n+1) having the low level L may be supplied to the $n+1^{th}$ sensing control line SCL(n+1).

Therefore, all of an $n+1^{th}$ sensing control transistor Tsw5(*n*+1) and an $n+1^{th}$ sensing switching transistor Tsw6(*n*+1) may be turned on, as illustrated in FIG. 12, the first terminal of the $n+1^{th}$ light emitting device ED(n+1) may be electrically connected to the sensing line SL.

That is, in the charging period CP, the reference voltage transferor 310 may be connected to the sensing line SL by the first switching control signal SS1 and the second control signal SMUX, and the first terminal of the $n+1^{th}$ light emitting device ED(n+1) may be electrically connected to the sensing line SL by the $n+1^{th}$ sensing switching pulse VSWp(n+1) and the $n+1^{th}$ sensing control pulse VSp(n+1).

Therefore, an electric charge may be charged into the first terminal of the n+1$^{th}$ light emitting device ED(n+1) included in the n+1$^{th}$ pixel P(n+1).

Finally, the switching unit 340 may connect the converter 330 to the sensing line SL until before the supply of the n+1$^{th}$ sensing switching pulse VSWp(n+1) stops from before the supply of the n+1$^{th}$ sensing control pulse VSp(n+1) stops.

That is, the converter 330 may be connected to the sensing line SL in the sensing period SP, and thus, the converter 330 may receive a sensing signal transferred through the sensing line SL and may convert the sensing signal into the sensing data Sdata.

Accordingly, in some embodiments, in the sensing period SP, as described above with reference to FIGS. 5 to 8, the third switching control signal SS3 may be supplied to the switching unit 340 so that the connection line CL connected to the sensing line SL is connected to the converter 330.

In the processes, when only an electric charge charged into the n+1$^{th}$ light emitting device ED(n+1) included in the n+1$^{th}$ pixel P(n+1) is transferred to the converter 330, a characteristic change of the n+1$^{th}$ light emitting device ED(n+1) included in the n+1$^{th}$ pixel P(n+1) may be accurately measured.

A period, where an electric charge charged into the n+1$^{th}$ light emitting device ED(n+1) included in the n+1$^{th}$ pixel P(n+1) is transferred to the converter 330, may be a period where the n+1$^{th}$ sensing control transistor Tsw5(*n*+1) and the n+1$^{th}$ sensing switching transistor Tsw6(*n*+1) included in the n+1$^{th}$ pixel P(n+1), and particularly, may be a period where the n+1$^{th}$ sensing control transistor Tsw5(*n*+1) is turned on.

Therefore, the n−1$^{th}$ pixel P(n−1) and the n$^{th}$ pixel P(n) should be electrically disconnected from the sensing line SL while the electric charge charged into the n+1 light emitting device ED(n+1) is being transferred to the converter 330 through the sensing line SL, so that only the electric charge charged into the n+1$^{th}$ light emitting device ED(n+1) included in the n+1$^{th}$ pixel P(n+1) is transferred to the converter 330 through the sensing line SL.

Accordingly, in some embodiments, in the present disclosure, as illustrated in FIG. 9, when the n+1$^{th}$ sensing control pulse VSp(n+1) is supplied to the n+1$^{th}$ sensing control line SCL(n+1) connected to the n+1$^{th}$ pixel P(n+1) connected to the n+1$^{th}$ gate line GLn+1, sensing switching off signals for turning off the sensing switching transistors Tsw6(*n*−1) and Tsw6(*n*) connected to the n−1$^{th}$ sensing switching line SSL(n−1) and the n$^{th}$ sensing switching line SSL(n) may be supplied to the n−1$^{th}$ sensing switching line SSL(n−1) connected to the n−1$^{th}$ pixel P(n−1) connected to the n−1$^{th}$ gate line GLn−1 and the n$^{th}$ sensing switching line SSL(n) connected to the n$^{th}$ pixel P(n) connected to the n$^{th}$ gate line GLn.

Moreover, when the n+1$^{th}$ sensing control pulse VSp(n+1) is supplied to the n+1$^{th}$ sensing control line SCL(n+1), sensing control off signals for turning off the sensing switching transistors Tsw5(*n*−1) and Tsw5(*n*) connected to the n−1$^{th}$ sensing control line SCL(n−1) and the n−1$^{th}$ sensing control line SCL(n−1) may be supplied to the n−1$^{th}$ sensing control line SCL(n−1) connected to the n−1$^{th}$ pixel P(n−1) and the n$^{th}$ sensing control line SCL(n) connected to the n$^{th}$ pixel P(n).

That is, as illustrated in FIG. 9, when the n+1$^{th}$ sensing control pulse VSp(n+1) is supplied to the n+1$^{th}$ pixel P(n+1), the n−1$^{th}$ sensing switching signal VSW(n−1) and the n$^{th}$ sensing switching signal VSW(n) may have the high level H, and the n−1$^{th}$ sensing control signal VS(n−1) and the n$^{th}$ sensing control signal VS(n) may have the high level H.

Therefore, all of the n−1$^{th}$ sensing switching transistor Tsw6(*n*−1) to which the n−1$^{th}$ sensing switching signal VSW(n−1) is supplied, the n$^{th}$ sensing switching transistor Tsw6(*n*) to which the n$^{th}$ sensing switching signal VSW(n) is supplied, the n−1$^{th}$ sensing control transistor Tsw5(*n*−1) to which the n−1$^{th}$ sensing control signal VS(n−1) is supplied, and the n$^{th}$ sensing control transistor Tsw5(*n*) to which the n$^{th}$ sensing control signal VS(n) is supplied may be turned off.

Therefore, electric charges leaked from the n−1$^{th}$ light emitting device ED(n−1) included in the n−1$^{th}$ pixel P(n−1) and the n$^{th}$ light emitting device ED(n) included in the n$^{th}$ pixel P(n) may not be transferred to the sensing line SL.

Therefore, only an electric charge transferred from the n+1 light emitting device ED(n+1) included in the n+1$^{th}$ pixel P(n+1) may be transferred to the converter 330 through the sensing line SL, and thus, only a characteristic change of the n+1$^{th}$ light emitting device ED(n+1) included in the n+1$^{th}$ pixel P(n+1) may be measured in the n+1$^{th}$ light emitting device sensing period ESP(n+1).

The embodiments of the present disclosure can also be described as follows:

According to an aspect of the present disclosure, there is provided a light emitting display panel. The light emitting display panel comprises a plurality of pixels, a plurality of gate lines transferring gate signals to the plurality of pixels, a plurality of data lines transferring data voltages to the plurality of pixels, and a sensing line coupled to a plurality of light emitting devices respectively included in the plurality of pixels. And each of the plurality of pixels includes a light emitting device, a sensing control transistor including a first terminal coupled to a first terminal of the light emitting device and a gate coupled to a sensing control line, and a sensing switching transistor including a first terminal coupled to a second terminal of the sensing control transistor, a second terminal coupled to the sensing line, and a gate connected to a sensing switching line.

The plurality of gate lines and the plurality of data lines may be arranged in different directions. The sensing line may be arranged in a first direction substantially parallel to the plurality of data lines. And the sensing line may be coupled to the sensing switching transistors of the plurality of pixels in the first direction.

Each of the plurality of pixels may further include a first transistor including a first terminal coupled to a corresponding data line and a gate coupled to a corresponding gate line, a driving transistor including a first terminal coupled to a first voltage supply line, a capacitor coupled between a second terminal of the first transistor and a gate of the driving transistor, a second transistor including a first terminal coupled to the gate of the driving transistor, a second terminal coupled to a second terminal of the driving transistor, and a gate coupled to the sensing control line, a third transistor including a first terminal coupled to the second terminal of the first transistor, a second terminal coupled to a second terminal of the sensing control transistor and the first terminal of the sensing switching transistor, and a gate coupled to an emission line, and a fourth transistor including a first terminal coupled to the second terminal of the driving transistor, a second terminal coupled to a first terminal of the light emitting device, and a gate coupled to the emission line.

According to another aspect of the present disclosure, there is provided a light emitting display apparatus. The light emitting display apparatus comprises a light emitting display panel including a plurality of pixels, a gate driver supplying a gate signal to a gate line included in the light emitting display panel, a data driver supplying a data voltage to a data line included in the light emitting display panel and converting a sensing signal, transferred through a sensing line included in the light emitting display panel, into sensing data, a controller storing the sensing data, and a switching driver coupling either the data line or the sensing line to the data driver on the basis of a switching driver control signal transferred from the controller. The sensing line is coupled to a plurality of light emitting devices respectively included in the plurality of pixels. And each of the plurality of pixels includes a light emitting device, a sensing control transistor including a first terminal coupled to a first terminal of the light emitting device and a gate coupled to a sensing control line, and a sensing switching transistor including a first terminal coupled to a second terminal of the sensing control transistor, a second terminal coupled to the sensing line, and a gate coupled to a sensing switching line.

The gate line and the data line may be arranged in different directions, the sensing line may be arranged in a first direction parallel to the data line, and the sensing line may be connected to the sensing switching transistors of the plurality of pixels in the first direction.

Each of the plurality of pixels may further include a first transistor including a first terminal coupled to the data line and a gate coupled to the gate line, a driving transistor including a first terminal coupled to a first voltage supply line, a capacitor coupled between a second terminal of the first transistor and a gate of the driving transistor, a second transistor including a first terminal coupled to the gate of the driving transistor, a second terminal coupled to a second terminal of the driving transistor, and a gate coupled to the sensing control line, a third transistor including a first terminal coupled to the second terminal of the first transistor, a second terminal coupled to a second terminal of the sensing control transistor and the first terminal of the sensing switching transistor, and a gate coupled to an emission line, and a fourth transistor including a first terminal coupled to the second terminal of the driving transistor, a second terminal coupled to a first terminal of the light emitting device, and a gate coupled to the emission line.

The data driver may comprise a data voltage generator generating a data voltage which is to be transferred to the data line, a reference voltage transferor transferring a reference voltage to the sensing line, a converter converting a sensing signal, transferred through the sensing line, into sensing data and transferring the sensing data to the controller, and a switching unit coupling the switching driver to one of the data voltage generator, the reference voltage transferor, and the converter.

The switching unit may comprise a first switching unit coupling the data line to the data driver, and a second switching unit coupling the sensing line to the data driver.

The sensing control line and the sensing switching line may couple to the gate driver, and a width of a sensing switching pulse supplied to the sensing switching line for turning on the sensing switching transistor may be greater than a width of a sensing control pulse supplied to the sensing control line for turning on the sensing control transistor.

The sensing switching pulse may be supplied to the sensing switching line, and the sensing control pulse may be supplied to the sensing control line.

Before the sensing control pulse is supplied to the sensing control line after the sensing switching pulse is supplied to the sensing switching line, the switching unit and the switching driver may couple the reference voltage transferor to the sensing line. And the switching unit may couple the converter to the sensing line until before the supply of the sensing switching pulse stops from before the supply of the sensing control pulse stops.

When a sensing control pulse is supplied to an $n^{th}$ sensing control line coupled to a pixel coupled to an $n^{th}$ gate line, a sensing switching off signal for turning off sensing switching transistors coupled to an $n-1^{th}$ sensing switching line and an $n+1^{th}$ sensing switching line may be supplied to the n−1 sensing switching line coupled to a pixel coupled to the $n-1^{th}$ gate line and the $n+1^{th}$ sensing switching line coupled to a pixel coupled to the $n+1^{th}$ gate line.

When a sensing control pulse for turning on a sensing control transistor coupled to the $n^{th}$ sensing control line is supplied to an $n^{th}$ sensing control line coupled to a pixel coupled to an $n^{th}$ gate line, a sensing switching off signal for turning off sensing switching transistors connected to an $n-1^{th}$ sensing switching line and an $n+1^{th}$ sensing switching line may be supplied to the $n-1^{th}$ sensing switching line coupled to pixels coupled to an $n-1^{th}$ gate line and the $n+1^{th}$ sensing switching line coupled to pixels connected to an $n+1^{th}$ gate line.

That is, according to the present disclosure described above, a characteristic change of a light emitting device may be accurately measured, and thus, various functions for compensating for a characteristic change of the light emitting device may be accurately performed.

According to the embodiments of the present disclosure, in pixels where a characteristic change of a light emitting device is not sensed, a current may not be leaked to a sensing line. Accordingly, the degree of characteristic change of a light emitting device sensed may be accurately sensed, and thus, the quality of a light emitting display apparatus may be enhanced.

The above-described feature, structure, and effect of the present disclosure are included in at least one embodiment of the present disclosure, but are not limited to only one embodiment. Furthermore, the feature, structure, and effect described in at least one embodiment of the present disclosure may be implemented through combination or modification of other embodiments by those skilled in the art. Therefore, content associated with the combination and modification should be construed as being within the scope of the present disclosure.

It will be apparent to those skilled in the art that various modifications and variations can be made in the present disclosure without departing from the spirit or scope of the disclosures. Thus, it is intended that the present disclosure covers the modifications and variations of this disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A light emitting display panel comprising:
a plurality of pixels;
a plurality of gate lines transferring gate signals to the plurality of pixels;
a plurality of data lines transferring data voltages to the plurality of pixels; and
a sensing line coupled to a plurality of light emitting devices respectively included in the plurality of pixels,
wherein each of the plurality of pixels includes:
a light emitting device;
a sensing control transistor including a first terminal coupled to a first terminal of the light emitting device and a gate coupled to a sensing control line;
a sensing switching transistor including a first terminal electrically connected to a second terminal of the sensing control transistor, a second terminal coupled to the sensing line, and a gate coupled to a sensing switching line;
a driving transistor having a first terminal coupled to a first voltage supply line; and
a second transistor having a first terminal coupled to the gate of the driving transistor, a second terminal coupled to a second terminal of the driving transistor, and a gate coupled to the sensing control line,
wherein the sensing control line is electrically connected to all pixels disposed along one of the plurality of gate lines,
wherein the sensing switching line is electrically connected to all the pixels disposed along a respective gate line,
wherein the sensing control line, in operation, provides same signals to the gate of the sensing control transistor and the gate of the second transistor, and
wherein the same signals is a sensing control signal.

2. The light emitting display panel of claim 1, wherein
the plurality of gate lines and the plurality of data lines are arranged in different directions,
the sensing line is arranged in a first direction substantially parallel to the plurality of data lines,
the sensing line is coupled to the sensing switching transistors of the plurality of pixels in the first direction.

3. The light emitting display panel of claim 1, wherein each of the plurality of pixels further includes:
a first transistor including a first terminal coupled to a corresponding data line and a gate coupled to a corresponding gate line;
a capacitor coupled between a second terminal of the first transistor and the gate of the driving transistor;
a third transistor including a first terminal coupled to the second terminal of the first transistor, a second terminal coupled to a second terminal of the sensing control transistor and the first terminal of the sensing switching transistor, and a gate coupled to an emission line; and
a fourth transistor including a first terminal coupled to the second terminal of the driving transistor, a second terminal coupled to a first terminal of the light emitting device, and a gate coupled to the emission line.

4. The light emitting display panel of claim 1, wherein the sensing control line and the sensing switching line are disposed independently of each other, and disposed in parallel.

5. The light emitting display panel of claim 1, wherein a signal supplied to the sensing control line and a signal supplied to the sensing switching line are independent and have different pulse widths.

6. A light emitting display apparatus comprising:
a light emitting display panel including a plurality of pixels;
a gate driver supplying a gate signal to a gate line included in the light emitting display panel;
a data driver supplying a data voltage to a data line included in the light emitting display panel and converting a sensing signal, transferred through a sensing line included in the light emitting display panel, into sensing data;
a controller storing the sensing data; and
a switching driver coupling either the data line or the sensing line to the data driver on the basis of a switching driver control signal transferred from the controller,
wherein
the sensing line is coupled to a plurality of light emitting devices respectively included in the plurality of pixels,
each of the plurality of pixels includes:
a light emitting device;
a sensing control transistor including a first terminal coupled to a first terminal of the light emitting device and a gate coupled to a sensing control line;
a sensing switching transistor including a first terminal coupled to a second terminal of the sensing control transistor, a second terminal coupled to the sensing line, and a gate coupled to a sensing switching line;
a driving transistor including a first terminal coupled to a first voltage supply line; and
a second transistor including a first terminal coupled to the gate of the driving transistor, a second terminal coupled to a second terminal of the driving transistor, and a gate coupled to the sensing control line,
wherein the sensing control line, in operation, provides same signals to the gate of the sensing control transistor and the gate of the second transistor, and
wherein the same signals is a sensing control signal.

7. The light emitting display apparatus of claim 6, wherein
the gate line and the data line are arranged in different directions,
the sensing line is arranged in a first direction substantially parallel to the data line, and
the sensing line is coupled to the sensing switching transistors of the plurality of pixels in the first direction.

8. The light emitting display apparatus of claim 6, wherein each of the plurality of pixels further includes:
a first transistor including a first terminal coupled to the data line and a gate coupled to the gate line;
a capacitor coupled between a second terminal of the first transistor and the gate of the driving transistor;
a third transistor including a first terminal coupled to the second terminal of the first transistor, a second terminal coupled to a second terminal of the sensing control transistor and the first terminal of the sensing switching transistor, and a gate coupled to an emission line; and
a fourth transistor including a first terminal coupled to the second terminal of the driving transistor, a second terminal coupled to a first terminal of the light emitting device, and a gate coupled to the emission line.

9. The light emitting display apparatus of claim 6, wherein the data driver comprises:
a data voltage generating circuit converting image data into a data voltage and transferring the data voltage to the data line;
a reference voltage transferring circuit generating a reference voltage by using power supplied from a power supply and transferring the reference voltage to the sensing line, or transferring a reference voltage supplied from the power supply to the sensing line;

an analog-to-digital converter converting an analog sensing signal, transferred through the sensing line, into digital sensing data and transferring the digital sensing data to the controller; and a switching unit coupling the switching driver to one of the data voltage generating circuit, the reference voltage transferring circuit, and the analog-to-digital converter.

10. The light emitting display apparatus of claim 6, wherein the switching unit comprises:

a first switching unit coupling the data line to the data driver; and a second switching unit coupling the sensing line to the data driver.

11. The light emitting display apparatus of claim 6, wherein the sensing control line and the sensing switching line are coupled to the gate driver, and a width of a sensing switching pulse supplied to the sensing switching line for turning on the sensing switching transistor is greater than a width of a sensing control pulse supplied to the sensing control line for turning on the sensing control transistor.

12. The light emitting display apparatus of claim 11, wherein the sensing switching pulse is supplied to the sensing switching line, and the sensing control pulse is supplied to the sensing control line.

13. The light emitting display apparatus of claim 12, wherein the data driver includes:

a data voltage generating circuit converting image data into a data voltage and transferring the data voltage to the data line;

a reference voltage transferring circuit generating a reference voltage by using power supplied from a power supply and transferring the reference voltage to the sensing line, or transferring a reference voltage supplied from the power supply to the sensing line;

an analog-to-digital converter converting an analog sensing signal, transferred through the sensing line, into digital sensing data and transferring the digital sensing data to the controller; and a switching unit coupling the switching driver to one of the data voltage generating circuit, the reference voltage transferring circuit, and the analog-to-digital converter.

14. The light emitting display apparatus of claim 13, wherein, before the sensing control pulse is supplied to the sensing control line after the sensing switching pulse is supplied to the sensing switching line, the switching unit and the switching driver couple the reference voltage transferring circuit to the sensing line, and the switching unit couples the analog-to-digital converter to the sensing line until before the supply of the sensing switching pulse stops from before the supply of the sensing control pulse stops.

15. The light emitting display apparatus of claim 14, wherein, when a sensing control pulse is supplied to an $n^{th}$ sensing control line coupled to a pixel coupled to an $n^{th}$ gate line, a sensing switching off signal for turning off sensing switching transistors coupled to an $n-1^{th}$ sensing switching line and an $n+1^{th}$ sensing switching line is supplied to the $n-1^{th}$ sensing switching line coupled to a pixel coupled to the $n-1^{th}$ gate line and the $n+1^{th}$ sensing switching line coupled to a pixel coupled to the $n+1^{th}$ gate line.

16. The light emitting display apparatus of claim 6, wherein, when a sensing control pulse for turning on a sensing control transistor coupled to the $n^{th}$ sensing control line is supplied to an $n^{th}$ sensing control line coupled to a pixel coupled to an $n^{th}$ gate line, a sensing switching off signal for turning off sensing switching transistors coupled to an $n-1^{th}$ sensing switching line and an $n+1^{th}$ sensing switching line is supplied to the $n-1^{th}$ sensing switching line coupled to pixels coupled to an $n-1^{th}$ gate line and the $n+1^{th}$ sensing switching line coupled to pixels connected to an $n+1^{th}$ gate line.

17. The light emitting display apparatus of claim 6, wherein the sensing control line and the sensing switching line are disposed independently of each other, and disposed in parallel.

18. The light emitting display apparatus of claim 6, wherein a signal supplied to the sensing control line and a signal supplied to the sensing switching line are independent and have different pulse widths.

* * * * *